US007271793B2

(12) United States Patent
Higashi

(10) Patent No.: US 7,271,793 B2
(45) Date of Patent: Sep. 18, 2007

(54) LIQUID CRYSTAL DISPLAY DEVICE, DRIVING METHOD FOR LIQUID CRYSTAL DISPLAY DEVICES, AND INSPECTION METHOD FOR LIQUID CRYSTAL DISPLAY DEVICES

(75) Inventor: Seiichiro Higashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/026,905

(22) Filed: Dec. 27, 2001

(65) Prior Publication Data

US 2002/0057251 A1 May 16, 2002

Related U.S. Application Data

(60) Division of application No. 09/218,497, filed on Dec. 22, 1998, now Pat. No. 6,337,677, which is a continuation of application No. 08/714,170, filed as application No. PCT/JP96/00202 on Feb. 1, 1996, now Pat. No. 6,023,260.

(30) Foreign Application Priority Data

Feb. 1, 1995 (JP) ..... 7-15120

(51) Int. Cl.
*G09G 3/36* (2006.01)

(52) U.S. Cl. ..... 345/100; 345/87; 345/98; 345/99; 345/200; 345/204

(58) Field of Classification Search ..... 345/94–100, 345/211

See application file for complete search history.

(56) References Cited

U.S. PATENT DOCUMENTS 4,447,812 A 5/1984 Soneda et al.

(Continued)

FOREIGN PATENT DOCUMENTS

EP 0 525 980 A2 2/1993

(Continued)

OTHER PUBLICATIONS

S. Inoue et al., "S16-2 425° C. Poly-Si TFT Technology and Its Applications to Large Size LCDs and Integrated Digital Date Drivers", *ASIA Display*, 1995, pp. 339-342.

(Continued)

*Primary Examiner*—Richard Hjerpe
*Assistant Examiner*—Leonid Shapiro
(74) *Attorney, Agent, or Firm*—Oliff & Berridge, PLC

(57) ABSTRACT

Using technology which uses a single shift register and simultaneously generates multiple pulses, this invention is a liquid crystal display device which rapidly drives data lines. It is possible to increase the frequency of the shift register output signal without changing the frequency of the shift register operation clock. If the shift register output signals, by means of analog switches, are used to determine the video signal sampling timing, high speed data line driving can be realized. Additionally, if the output signals of the shift register mentioned above are used to determine the video signal latch timing in a digital driver, high speed latching of the video signal can be realized. Consequently, even if the driving circuits of the liquid crystal display matrix are composed of TFTs, high speed operation of the driving circuits is possible without increasing power consumption. The shift register can also be used to inspect the electrical characteristics of the data lines and analog switches.

8 Claims, 25 Drawing Sheets

U.S. PATENT DOCUMENTS

| | | | | | |
|---|---|---|---|---|---|
| 4,736,137 | A | | 4/1988 | Ohwada et al. | |
| 4,816,816 | A | * | 3/1989 | Usui | 345/103 |
| 4,901,066 | A | * | 2/1990 | Kobayashi et al. | 345/94 |
| 4,965,566 | A | | 10/1990 | Kawamura et al. | |
| 5,038,139 | A | | 8/1991 | Fujisawa et al. | 345/98 |
| 5,040,874 | A | * | 8/1991 | Fukuda | 349/143 |
| 5,051,739 | A | | 9/1991 | Hayashida et al. | 345/98 |
| 5,162,786 | A | | 11/1992 | Fukuda | 345/100 |
| 5,166,671 | A | | 11/1992 | Maekawa | 345/100 |
| 5,170,158 | A | | 12/1992 | Shinya | |
| 5,192,945 | A | | 3/1993 | Kusada | 345/100 |
| 5,223,824 | A | | 6/1993 | Takeda et al. | 340/813 |
| 5,248,963 | A | | 9/1993 | Yasui et al. | 345/98 |
| 5,250,931 | A | | 10/1993 | Misawa et al. | |
| 5,251,051 | A | | 10/1993 | Fujiyoshi et al. | 345/98 |
| 5,270,696 | A | * | 12/1993 | Shin et al. | 345/204 |
| 5,283,556 | A | | 2/1994 | Ise | 345/174 |
| 5,289,518 | A | | 2/1994 | Nakao | |
| 5,307,085 | A | * | 4/1994 | Nakamura | 345/99 |
| 5,335,023 | A | | 8/1994 | Edwards | |
| 5,335,254 | A | * | 8/1994 | Tu et al. | 377/76 |
| 5,365,284 | A | * | 11/1994 | Matsumoto et al. | 348/793 |
| 5,412,397 | A | * | 5/1995 | Kanatani et al. | 345/99 |
| 5,418,551 | A | | 5/1995 | Ise | 345/174 |
| 5,432,529 | A | | 7/1995 | Azuhata | |
| 5,448,259 | A | | 9/1995 | Hidaka | 345/98 |
| 5,459,495 | A | * | 10/1995 | Scheffer et al. | 345/690 |
| 5,461,424 | A | | 10/1995 | Shimizu | |
| 5,481,651 | A | * | 1/1996 | Herold | 345/94 |
| 5,523,772 | A | | 6/1996 | Lee | 345/98 |
| 5,528,267 | A | | 6/1996 | Ise | 345/174 |
| 5,532,712 | A | | 7/1996 | Tsuda et al. | |
| 5,534,885 | A | | 7/1996 | Saitoh | 345/98 |
| 5,576,730 | A | * | 11/1996 | Shimada et al. | 345/98 |
| 5,583,535 | A | | 12/1996 | Takarada et al. | |
| 5,623,279 | A | | 4/1997 | Itakura et al. | |
| 5,648,791 | A | * | 7/1997 | Date et al. | 345/89 |
| 5,682,175 | A | | 10/1997 | Kitamura | 345/100 |
| 5,686,936 | A | * | 11/1997 | Maekawa et al. | 345/100 |
| 5,726,677 | A | | 3/1998 | Imamura | |
| 5,754,152 | A | | 5/1998 | Nakamura et al. | 345/98 |
| 5,801,673 | A | * | 9/1998 | Shimada et al. | 345/100 |
| 5,818,412 | A | | 10/1998 | Maekawa | |
| 5,818,413 | A | | 10/1998 | Hayashi et al. | 345/100 |
| 5,850,204 | A | | 12/1998 | Maekawa | 345/100 |
| 5,856,816 | A | * | 1/1999 | Youn | 345/98 |
| 5,883,609 | A | | 3/1999 | Asada et al. | 345/100 |
| 6,320,566 | B1 | * | 11/2001 | Go | 345/99 |
| 6,483,497 | B1 | * | 11/2002 | Iino et al. | 345/100 |
| 6,559,824 | B1 | * | 5/2003 | Kubota et al. | 345/100 |
| 6,628,261 | B1 | * | 9/2003 | Sato et al. | 345/99 |
| 6,670,943 | B1 | * | 12/2003 | Ishii et al. | 345/100 |
| 6,930,665 | B2 | * | 8/2005 | Sekine | 345/100 |

FOREIGN PATENT DOCUMENTS

| | | | | |
|---|---|---|---|---|
| EP | 0 525 980 | A3 | | 2/1993 |
| EP | 0 541 364 | A | | 5/1993 |
| EP | 0 570 925 | A1 | | 11/1993 |
| EP | 0 614 165 | A1 | | 9/1994 |
| EP | 0678848 | | * | 10/1995 |
| GB | 2081018 | | * | 10/1982 |
| JP | 57-38498 | | | 3/1982 |
| JP | A-58-11995 | | | 1/1983 |
| JP | 60-2989 | | | 1/1985 |
| JP | 60-52892 | | | 3/1985 |
| JP | A-61-32093 | | | 2/1986 |
| JP | A-62-12846 | | | 1/1987 |
| JP | 62-203067 | | | 9/1987 |
| JP | A-62-214783 | | | 9/1987 |
| JP | A-62-223728 | | | 10/1987 |
| JP | A-63-52121 | | | 3/1988 |
| JP | A-63-161495 | | | 7/1988 |
| JP | A-64-18193 | | | 1/1989 |
| JP | A-1-142796 | | | 6/1989 |
| JP | A-2-74990 | | | 3/1990 |
| JP | A-2-082295 | | | 3/1990 |
| JP | 2-204718 | | | 8/1990 |
| JP | 3-217891 | | | 9/1991 |
| JP | A-4-195189 | | | 7/1992 |
| JP | 5-5866 | | | 1/1993 |
| JP | A-5-5897 | | | 1/1993 |
| JP | 5-28789 | | | 2/1993 |
| JP | A-5-35221 | | | 2/1993 |
| JP | A-5-127627 | | | 2/1993 |
| JP | 5-40319 | | | 6/1993 |
| JP | 5-219461 | | | 8/1993 |
| JP | A-5-216441 | | | 8/1993 |
| JP | A-5-265411 | | | 10/1993 |
| JP | A-5-281928 | | | 10/1993 |
| JP | A-6-43490 | | | 2/1994 |
| JP | 6-67188 | | | 3/1994 |
| JP | A-6-124067 | | | 5/1994 |
| JP | A-6-348232 | | | 12/1994 |
| JP | A-7-255063 | | | 10/1995 |
| JP | 7-306662 | | | 11/1995 |
| JP | A-8-30241 | | | 2/1996 |
| JP | 8-27463 | | | 3/1996 |
| JP | A-8-79663 | | | 3/1996 |
| JP | A-8-122748 | | | 5/1996 |

OTHER PUBLICATIONS

Y. Matsueda et al., "30.1: A 6-bit-Color VGA Low-Temperature Poly-Si TFT-LCD with Integrated Digital Data Drivers", *SID 98 Digest*, 1998, pp. 879-882.

Y. Matsueda et al., "4.2: Low-Temperature Poly Si TFT-LCD with Integrated 6-bit Digital Data Drivers", *SID 96 Digest*, 1996, pp. 21-24.

Y. Nishihara et al., "32.5 Fully Integrated Poly Si TFT CMOS Drivers for Self-Scanned Light Valve", *SID Digest* (1992), pp. 609-612.

Da Costa et al., "Amorphous Silicon Shift Register For Addressing Output Drivers", *IEEE Journal of Solid-State Circuits*, 1994; pp. 596-599.

* cited by examiner

TIME

| | 1 | 2 | 3 | 4 | 5 | 161 | 162 | 163 | 164 | 165 | 321 | 322 | 323 | 324 | 325 | 481 | 482 | 483 | 484 | 485 |
|---|---|---|---|---|---|---|---|---|---|---|---|---|---|---|---|---|---|---|---|---|
| | O | | | | | O | | | | | O | | | | | O | | | | |
| | | O | | | | | O | | | | | O | | | | | O | | | |
| | | | O | | | | | O | | | | | O | | | | | O | | |
| | | | | O | | | | | O | | | | | O | | | | | O | |

TIME

| | 1 | 2 | 3 | 4 | 5 | 161 | 162 | 163 | 164 | 165 | 321 | 322 | 323 | 324 | 325 | 481 | 482 | 483 | 484 | 485 |
|---|---|---|---|---|---|---|---|---|---|---|---|---|---|---|---|---|---|---|---|---|
| | O | | | | | | | | | | | | | | | | | | | |
| | | O | | | | | | | | | | | | | | | | | | |
| | | | O | | | | | | | | | | | | | | | | | |
| | | | | O | | | | | | | | | | | | | | | | |

LIQUID CRYSTAL DISPLAY DEVICE, DRIVING METHOD FOR LIQUID CRYSTAL DISPLAY DEVICES, AND INSPECTION METHOD FOR LIQUID CRYSTAL DISPLAY DEVICES

This is a Division of application Ser. No. 09/218,497 filed Dec. 22, 1998 now U.S. Pat. No. 6,337,677, which in turn is a Continuation of application Ser. No. 08/714,170 filed Sep. 27, 1996 now U.S. Pat. No. 6,023,260, which in turn is a U.S. National Stage of PCT/JP96/00202 filed Feb. 1, 1996. The entire disclosure of the prior application(s) is hereby incorporated by reference herein in its entirety.

FIELD OF TECHNOLOGY

This invention pertains to a liquid crystal display device, driving methods for liquid crystal display devices, inspection methods for electrical properties of liquid crystal display devices; and, in particular, liquid crystal display devices such as those in which transistors are formed on a liquid crystal matrix substrate for the purpose of driving a liquid crystal matrix.

BACKGROUND OF INVENTION

In an active matrix liquid crystal display device using thin film transistors (abbreviated as TFTs in the remainder of this document) as the switching elements, if it is possible to form the active matrix driving circuits from TFTs and fabricate those TFTs at the same time as the picture element (pixel) TFTs on the active matrix substrate, the need to provide driver integrated circuits (ICs) is removed; and this is convenient.

Compared to transistors integrated on single crystal silicon, however, the operating speeds of TFTs are slow and there is a definite limit to the increase in driving circuit speed attainable. Additionally, if the driving circuits are made to operate at high speeds, the power consumption will increase by that much more.

As examples of technology for operating driving circuits of liquid crystal display devices at high speed, there is the technology in Japanese Unexamined Patent Application Showa 61-32093 and the technology in pages 609-612 of the SID Digest (1992).

In the technology described in Japanese Unexamined Patent Application Showa 61-32093, the driving circuits are composed of multiple shift registers and, by driving each shift register by clocks with slightly different phases, the effective operating frequency of the shift registers is increased.

In the SID Digest (1992), pages 609-612, technology in which multiple analog switches are driven collectively by a single output of a timing control circuit and the video signal is written in parallel is shown.

As examples of technology striving for reduced power consumption in driving circuits, there is the technology contained in Japanese Unexamined Patent Application Showa 61-32093. This technology achieves reduced power consumption by dividing the driving circuits into multiple blocks and operating only blocks which must be used while keeping all other blocks out of operation.

When actually implementing the technology described in Japanese Unexamined Patent Application 61-32093, however, it is necessary to provide multiple clocks with differing phases which leads to increased complexity of the circuit configurations and an increase in the number of terminals.

Further, in the technology described in the SID Digest (1992), pages 609-612, because multiple analog switches are driven collectively, the load is heavy and it is necessary to provide a buffer which can drive a heavy load. Additionally, because of delays in the driving signals, it is easy for deviations to occur in the driving timing of each analog switch.

In the technology of Japanese Unexamined Patent Application 61-32093, a control circuit is necessary in order to selectively operate the divided blocks; and this leads to increased complexity of the circuitry. Additionally, this technology does not contribute at all to increasing the speed of the driving circuits.

Furthermore, when the driving circuits of the prior art described above are composed of TFTs, the circuits become complex in all cases; and the accurate, fast inspection of the circuits' electrical characteristics is difficult such that there are problems in the evaluation of reliability.

DESCRIPTION OF THE INVENTION

The present invention has taken the problems of the prior art described above into consideration. The purpose is to provide a novel liquid crystal display device and associated driving methods which allow high speed operation, a certain degree of reduction in power consumption, and ease of inspection.

In one mode of the liquid crystal display device of the present invention, multiple pulses are generated simultaneously using a single shift register.

Consequently, the frequency of the shift register output signal can be increased without changing the frequency of the shift register operation clock. When the number of simultaneously generated pulses is N (N is natural number of two or greater), the frequency of the output signal of the shift register becomes N-times.

If the shift register output signal mentioned above is used to determine the sampling timing of the video signal in an analog driver, high speed data line driving can be realized. Also, if the shift register output signal mentioned above is used to determine the latch timing of the video signal in a digital driver, high speed latching of the video signal can be realized. Consequently, high speed operation of the driving circuits is possible without increasing power consumption even when the driving circuits of the liquid crystal matrix are composed of TFTs.

In the simultaneous generation of multiple pulses using a single shift register, it is good if a stationary state such as that obtained when, for example, a single same-polarity pulse is input to the shift register input terminal after one horizontal period of the video signal, waiting for the passage of at least (N-1) horizontal periods and N mutually spaced, parallel pulses are output from the output terminals of each stage of the shift register.

In another mode of the liquid crystal display device of the present invention, gate circuits are added to the single shift register with the output signals of the shift register input to the gate circuits, and the output signals of the gate circuits used as timing control signals of the circuits comprising the data line driving circuits. For example, the output signals of the gate circuits can be used as timing signals to determine the sampling timing of the video signal in an analog driver and can be used as timing signals to determine the latch timing of the video signal in a digital driver.

For example, if an EXCLUSIVE-OR gate is used as the gate circuit and the output of adjacent stages of the shift register are input into the EXCLUSIVE-OR gate, and a clock which makes two horizontal periods of the video signal one period is input to the shift register, the number of clock level changes in one horizontal period are reduced and further reduction in power consumption is possible.

In another mode of the liquid crystal display device of the present invention, by making the most use of a single shift register, a configuration which can perform electrical inspection of a liquid crystal matrix is achieved. For example, an input circuit for a testing signal is connected to one end of the data lines and video signal input lines are connected to the other ends of the data lines through analog switches.

Using the inspection signal input circuit, the inspection signals are input collectively to the data lines. Maintaining such an input, single pulses are output successively from the single shift register and these pulses are used to successively turn on multiple analog switches. The electrical characteristics of the data lines and analog switches can be inspected by receiving the inspection signals sent from one end of said data lines by way of the analog switches and the video signal input lines. For example, it is possible to accurately and quickly detect such things as frequency characteristics of data lines and analog switches as well as data line open circuits.

DETAILED DESCRIPTION OF THE PREFERRED EMBODIMENTS

Using specific examples of the present invention, the contents of the present invention will be described in more detail below.

EXAMPLE 1

Overall Configuration

Figure 1A:
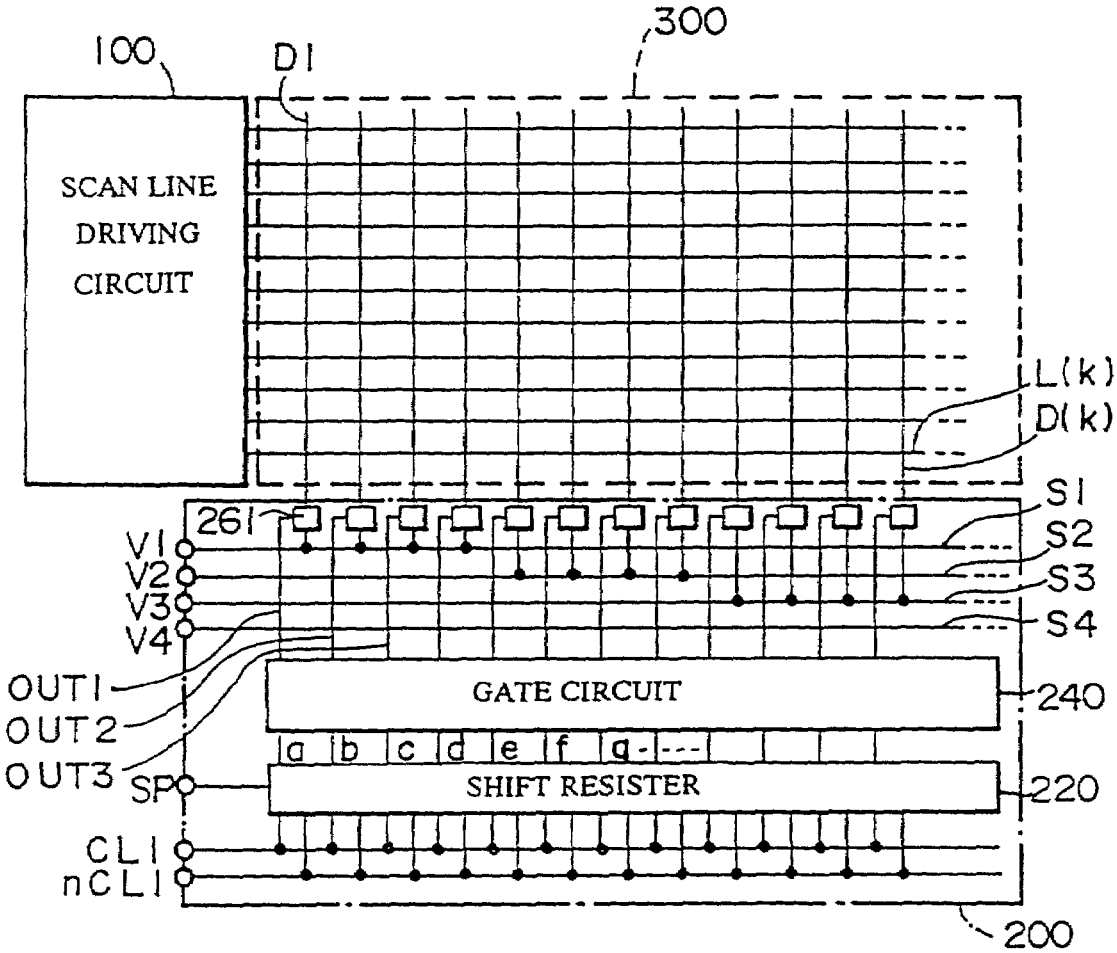
FIG. 1A shows the overall configuration of an example of a liquid crystal display device of the present invention.
Figure 1B:
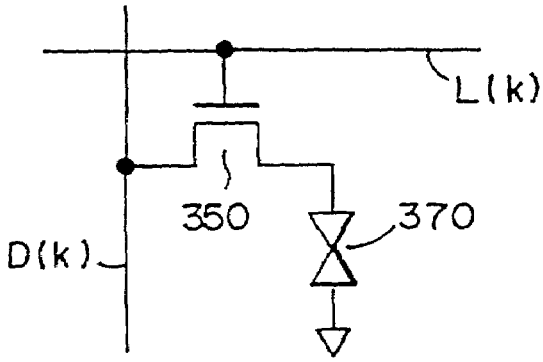
FIG. 1B shows the configuration of the pixel region.

FIG. 1A shows the configuration of an example of a liquid crystal display device of the present invention, and FIG. 1B shows the configuration of the pixel region of an active matrix liquid crystal display device.

This is an example of a liquid crystal display device employing data line driving using analog switches (switch circuits).

Further, in this example, TFTs are used as the transistors comprising the data line driving circuit. These TFTs are fabricated on the substrate at the same time as the switching TFTs in the pixel region. The fabrication process will be described later.

A single pixel in pixel region (active matrix) 300 is composed of switching TFT 350 and liquid crystal element 370 as shown in FIG. 1B. The gate of TFT 350 is connected to scan line L(k) and the source (drain) is connected to data line D(k).

Scan lines L(k) are driven by scan line driving circuit 100 shown in FIG. 1A, and data lines D(k) are driven by data line driving circuit 200 shown in FIG. 1A.

Data line driving circuit 200 contains shift register 220 having at least as many stages as the number of data lines, gate circuit 240, and multiple analog switches 261 which are connected to N (in this example, four) video image lines (S1 to S4).

The use of N video image lines (S1 to S4) means that the video signal is multiplexed with a degree of multiplexing of N.

Every M switches, where is M is any number (M is 4 in this example), of the multiple analog switches are grouped; and the total number of groups is equal to the total number of video signal lines (that is, N). In other words, in this example four analog switches are in one group; and each analog switch in one group is connected in common to a single video image line.

In FIG. 1A, V1, V2, V3, and V4 indicate the multiplexed video signal; SP indicates the start pulse input into shift register 220; and CL1 and nCL1 indicate operation clocks. CL1 and nCL1 are pulses with phases shifted by 180 degrees. In the explanations that follow, in other pulse signals, clocks which have been phase-shifted by 180 degrees are indicated by a prefix "n". Also, a digital signal of "1" corresponds to a positive pulse and a digital signal of "0" corresponds to a negative pulse.

Figure 4A:
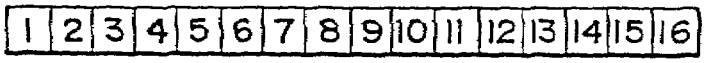
FIG. 4A shows the arrangement of the original image data.
Figure 4B:
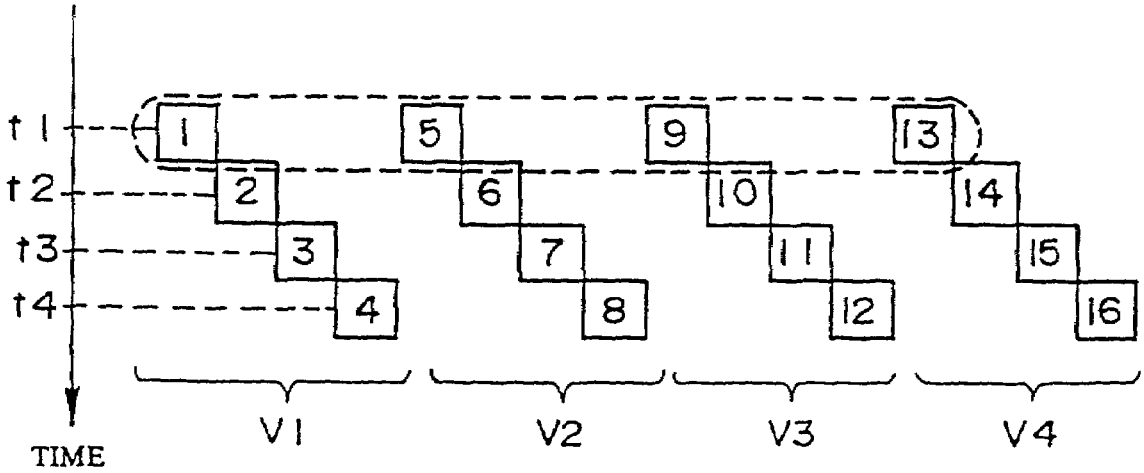
FIG. 4B shows an example of the data arrangement when the original image data have been arranged in a time series according to the methods of the present invention.

The meaning of the multiplexing of the video image is shown in FIG. 4B. As shown in FIG. 4A, if a video signal ranging from 1 to 16 is taken as an example, normally each signal would be arranged in a time sequential order.

When the signal is multiplexed to a degree of four as in the present example, however, at time t1, individual signals 1, 5, 9, and 13 appear simultaneously in video signals V1 to V4 as shown in FIG. 4B. Subsequently, at time t2, individual signals 2, 6, 10, and 14 appear simultaneously in the same way. At time t3, individual signals 3, 7, 11, and 15 appear simultaneously; and at time t4 individual signals 4, 8, 12, and 16 appear simultaneously.

Figure 5:
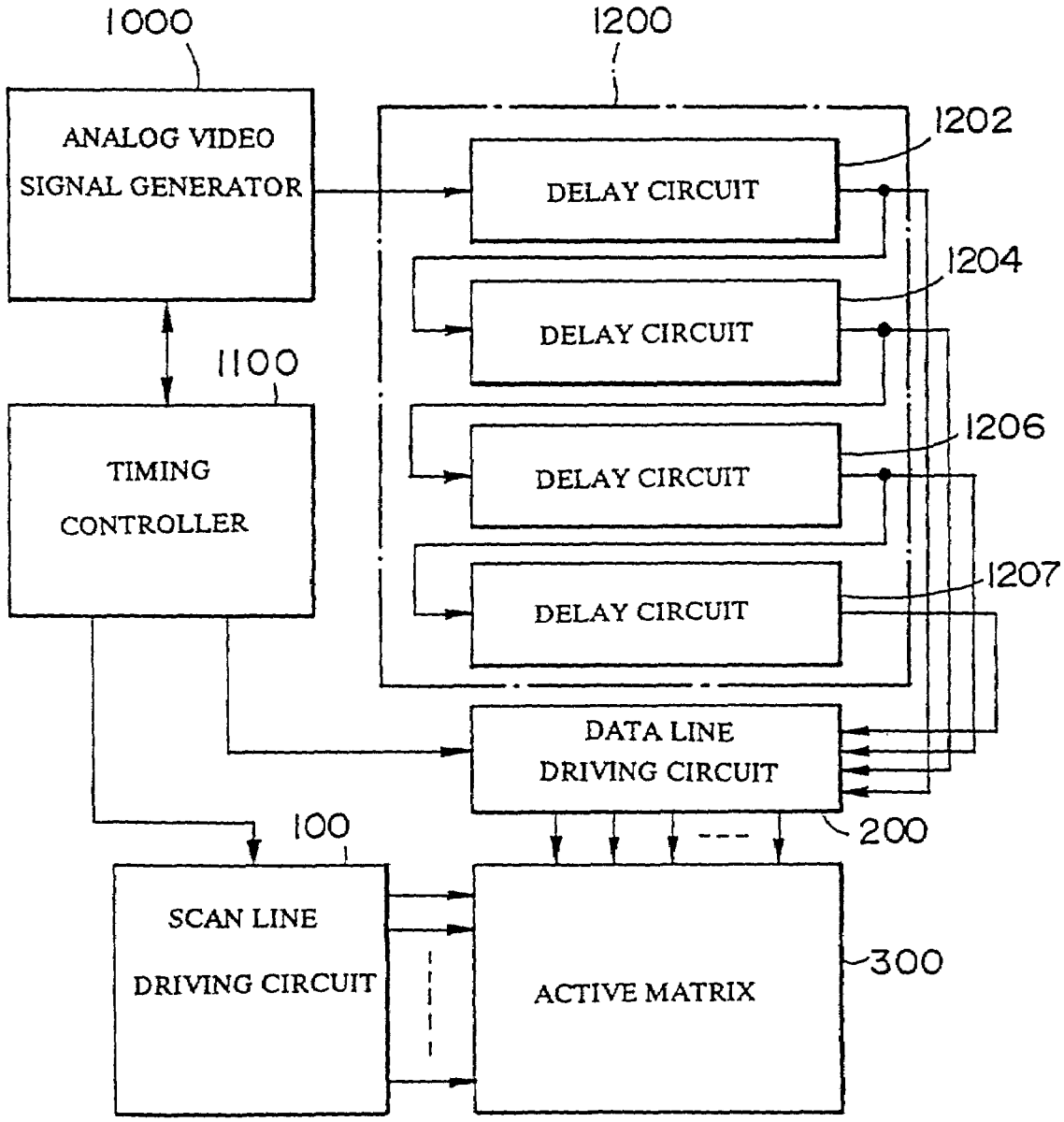
FIG. 5 shows an example of the circuit configuration for processing an analog signal into a multiplexed signal as shown in FIG. 4B.
Figure 6:
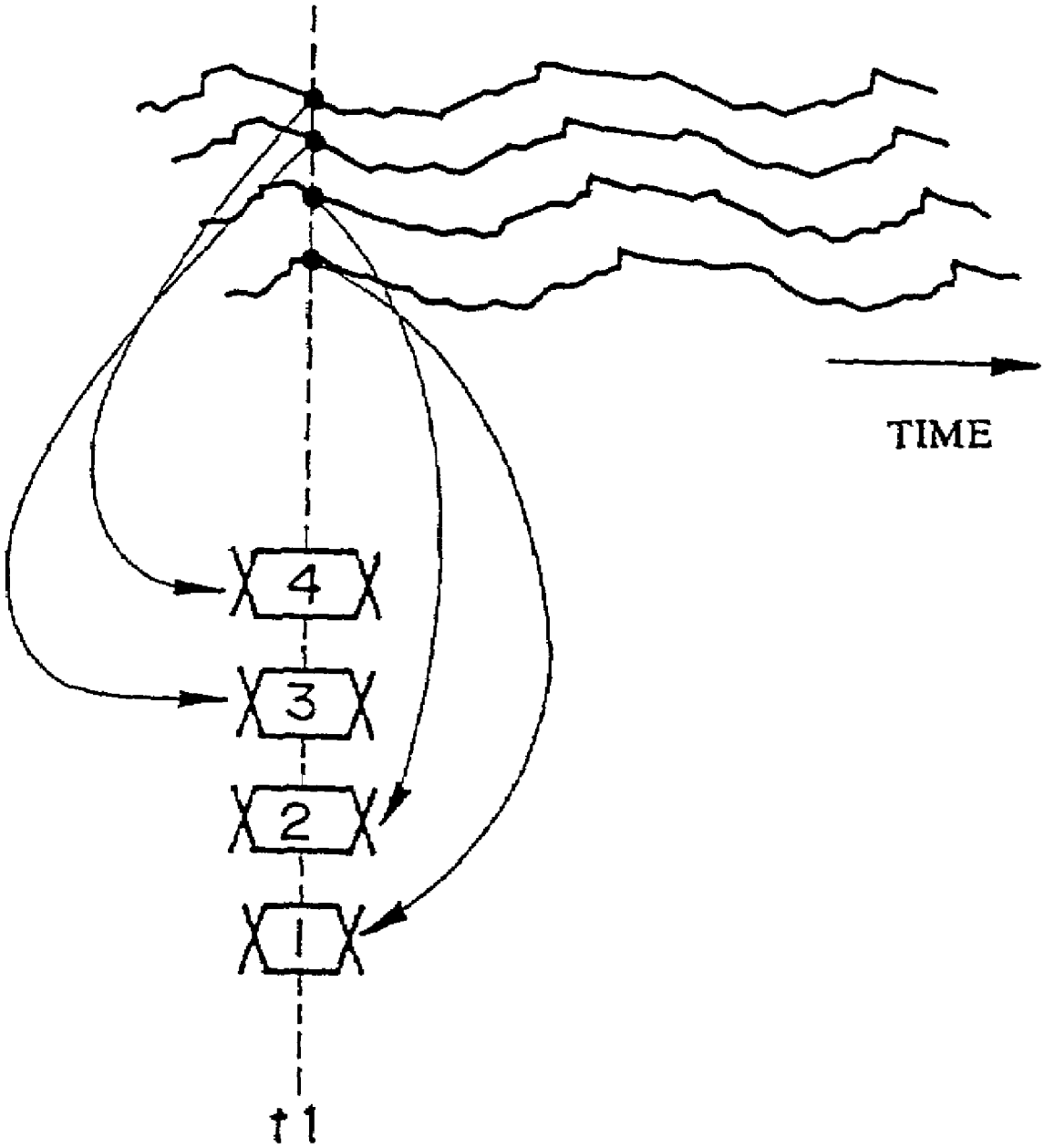
FIG. 6 is to explain the major operation of the circuits in FIG. 5.

The video signal multiplexing is possible, for example, by successively delaying the video signal by small amounts to make multiple video signals with slightly different phases as shown in FIG. 6. Such video signal delay can be achieved, for example, by using a delay circuit such as delay circuit 1200 shown in FIG. 5. Delay circuit 1200 is composed of four delay circuits 1202 to 1207 with identical amounts of delay connected in series. The outputs of each delay circuit supply data line driving circuit 200. In FIG. 5, reference number 1000 is an analog video signal generator; and reference number 1100 is a timing controller.

In the present example, an increase in data line driving speed is achieved by multiplexing the video signal in the manner mentioned above, while simultaneously generating with a single shift register the number of pulses corresponding to the degree of multiplexing, simultaneously driving multiple analog switches, and simultaneously supplying the video signal to multiple data lines.

Figure 21:
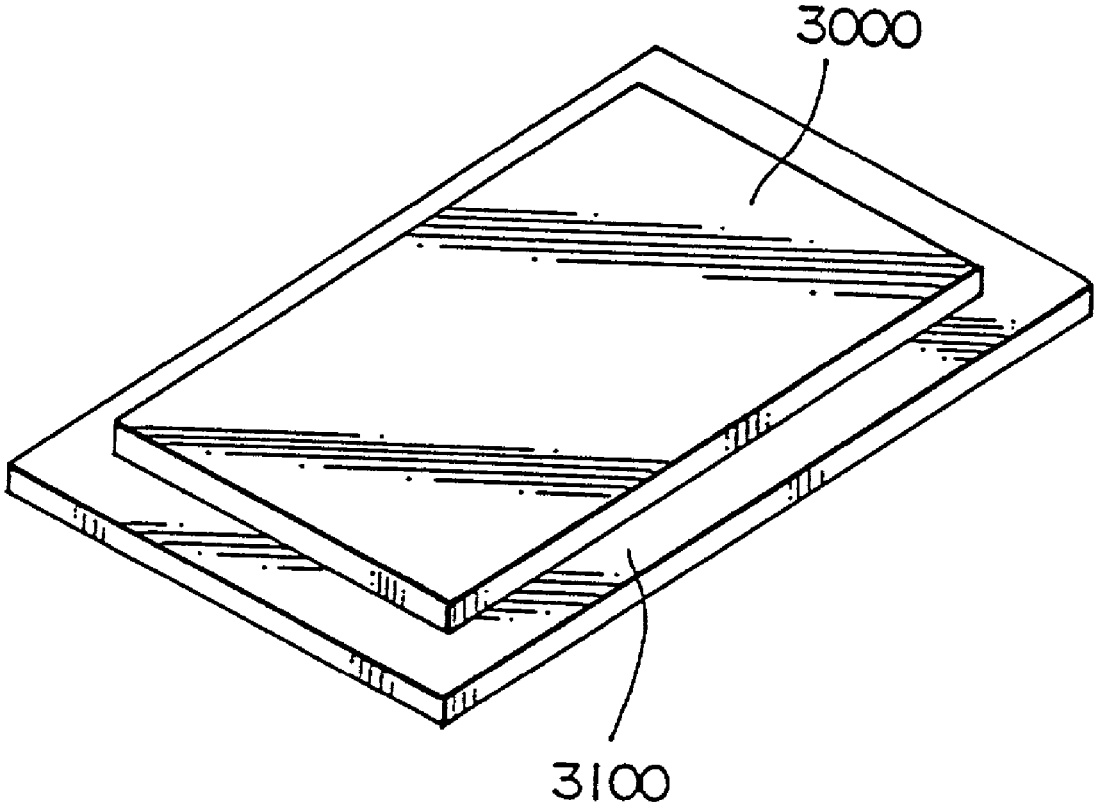
FIG. 21 shows an oblique projection of the structure of a liquid crystal display device.

As shown in FIG. 21, the actual liquid crystal display device is formed by the combination of the active matrix substrate 3100 and the counter substrate 3000. The liquid crystal is injected between the two substrates.

Specific Configuration of the Data Line Driving Circuit

In this example, there are special characteristics in the operation of the data line driving circuit 200 and these will be explained specifically below.

Figure 2:
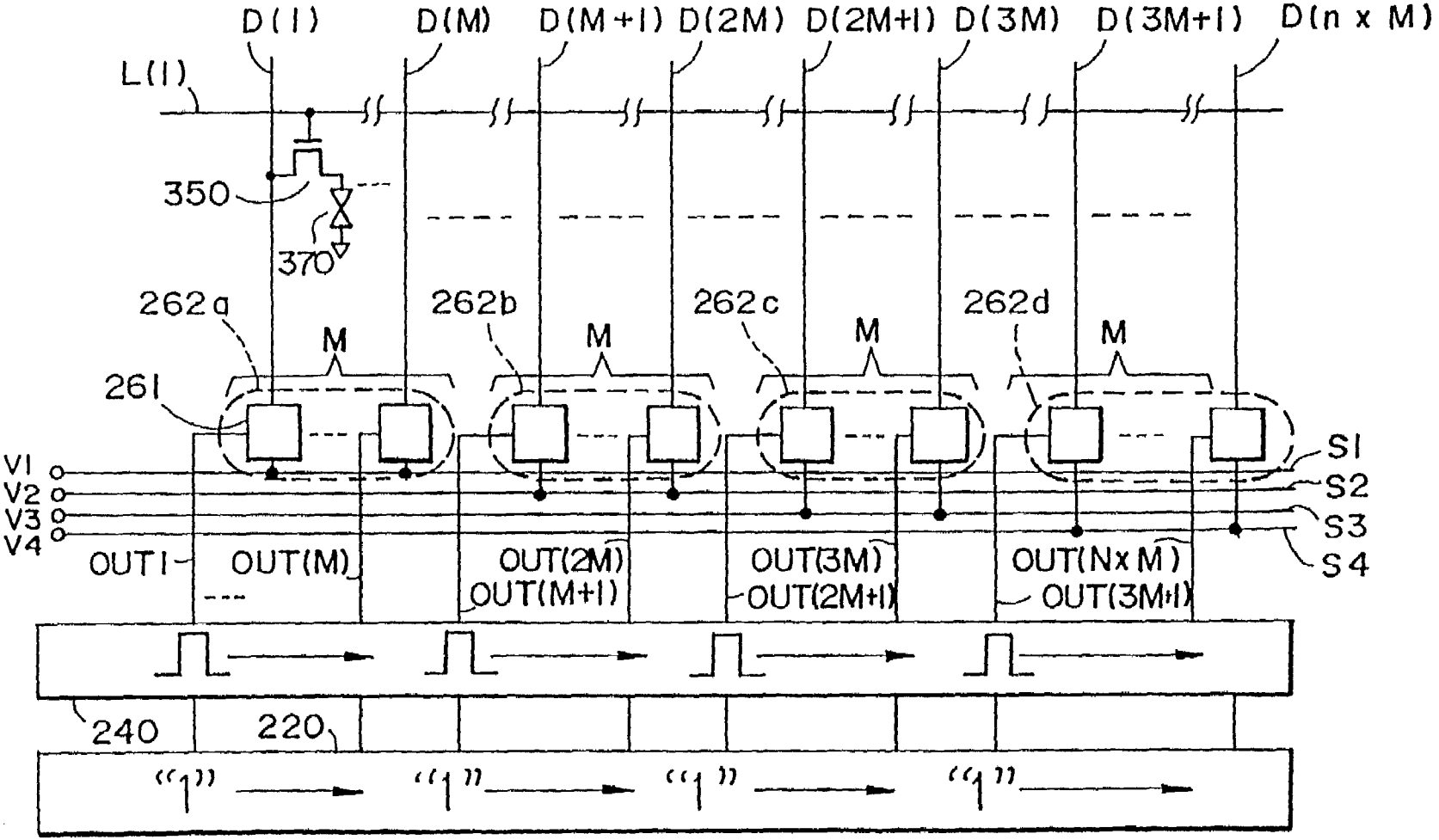
FIG. 2 is to explain the features of the example shown in FIGS. 1A-1B.

As shown in FIG. 2, in this example, in shift register 220, multiple uniformly spaced positive pulses (a single pulse corresponds to data "1") are simultaneously shifted; and, corresponding to these, multiple mutually spaced pulses are output in parallel from each stage of the shift register. The number of parallel pulses is equivalent to the degree of multiplexing N of the video signal described above. In this example then, there are four.

These pulses are used to determine the operation timing of the analog switches 261. Specifically, these pulses are input into gate circuit 240; and mutually spaced, multiple parallel pulses are output from the output terminals (OUT1 to OUT (N×M)) of gate circuit 240.

Then, in this example, these pulses output from gate circuit 240 are used to determine the sampling timing of the video signal from the analog switches.

Figure 23A:
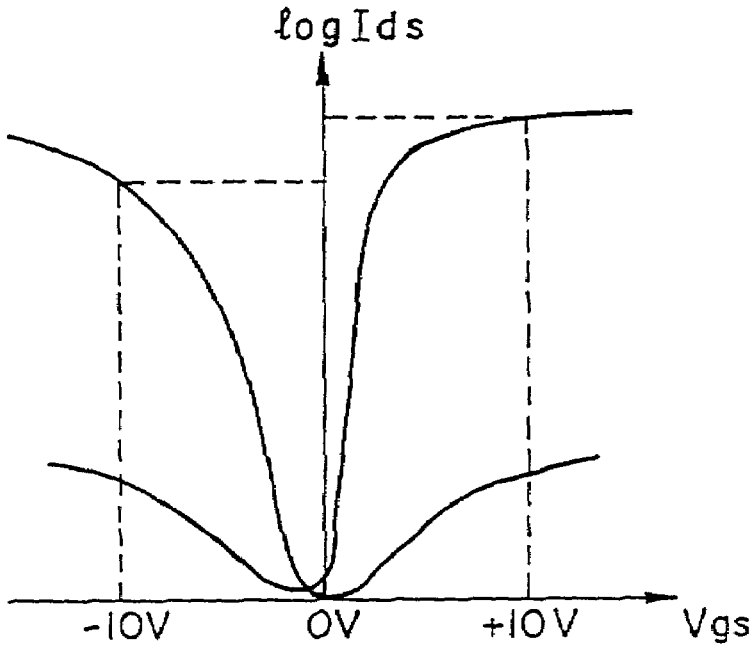
FIG. 23A shows the voltage-current characteristics for p-channel and n-channel TFTs.
Figure 23B:
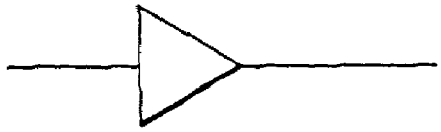
FIG. 23B shows the circuit diagram of a buffer circuit using p-channel TFTs and n-channel TFTs.
Figure 23C:
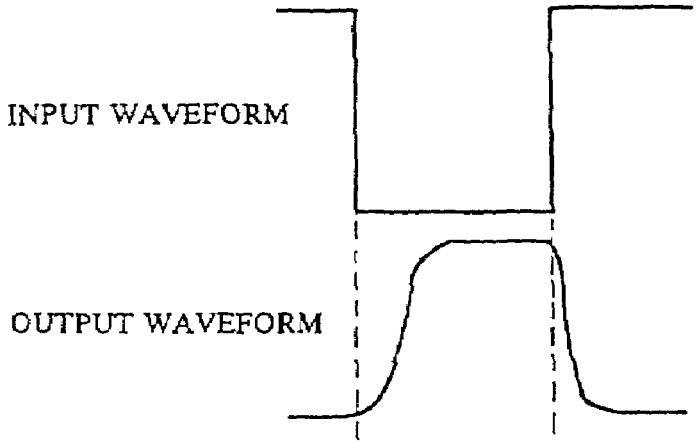
FIG. 23C shows input and output waveforms for the circuit of FIG. 23B.

Gate circuit 240 is used for waveform shaping. That is, there are differences in the voltage-current characteristics of p-channel and n-channel TFTs as shown in FIG. 23A. Therefore, if buffers such as those shown in FIG. 23B using these TFTs as output stage transistors are constructed, the output waveform will dull with respect to the input waveform as shown in FIG. 23C, thereby introducing signal delay. In order to control such delay, it is desirable to provide gate circuit 240. It is not absolutely essential, however, and direct driving of analog switches 261 by the shift register output signal is also acceptable.

Figure 3:
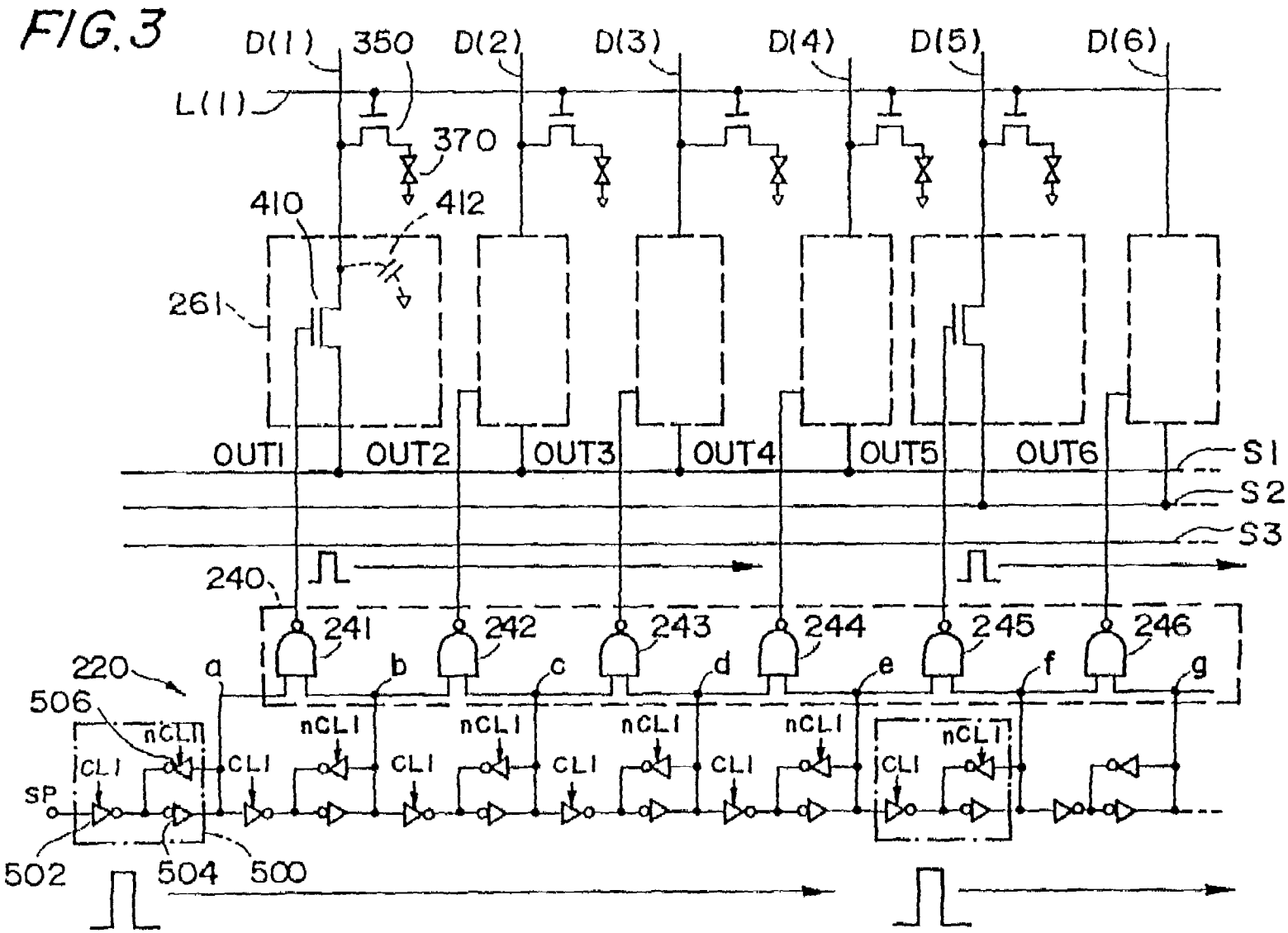
FIG. 3 is a more specific circuit diagram of the circuit configuration shown in FIG. 2.

A more specific circuit configuration of data line driving circuit 200 is shown in FIG. 3.

As is shown clearly in FIG. 3, analog switch 261 is comprised of MOS transistor 410. Additionally, reference number 412 is the capacitance of the data line itself (called data line capacitance from hereon).

A single stage of shift register 220 (reference number 500) is comprised of inverter 504 and clocked inverters 502 and 506.

Gate circuit 240 has dual input NAND gates 241 to 246 which accept as inputs the outputs from two adjacent stages of the shift register.

Explanation of Circuit Operation

Figure 9:
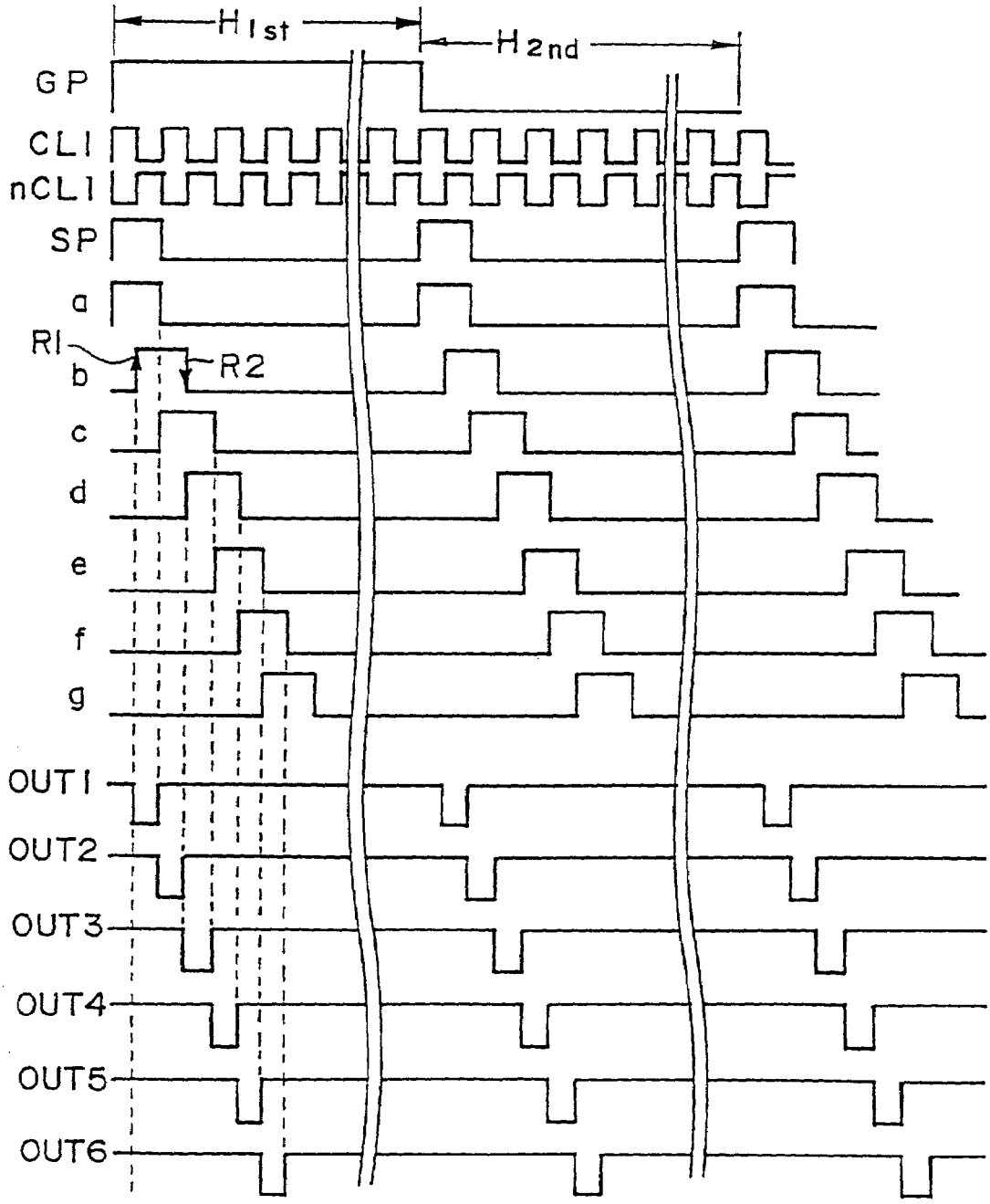
FIG. 9 is a timing chart showing the operation timing of the circuits shown in FIG. 1A, FIG. 2, and FIG. 3.

Next, the operation of the circuit shown in FIG. 3 will be explained in detail using FIG. 9 and FIG. 10. FIG. 9 shows the initial stages of operation prior to the time at which the four parallel pulses from shift register 220 are output steadily (that condition is shown in FIG. 10).

In FIG. 9, a through g, display the signal waveforms at the output terminals, shown in FIG. 3, of each stage of shift register 220; and OUT1 through OUT6 display the output signal waveforms of each of the NAND gates 241 to 246 also shown in FIG. 3. GP is the select pulse for a single scan line; and H1st indicates the first select period while H2nd indicates the second select period. Also, as explained above, CL1 and nCL1 are the operation clocks; and SP is the start pulse. The same definitions apply to FIG. 10.

As shown in FIG. 9, when a single start pulse (SP) is sequentially input to shift register 200 in the first select period (1H), a single pulse corresponding to this input pulse is output from each stage of shift register 220, and this pulse is sequentially shifted. In response, a single pulse is sequentially output from each of NAND gates 241 through 246.

Figure 10:
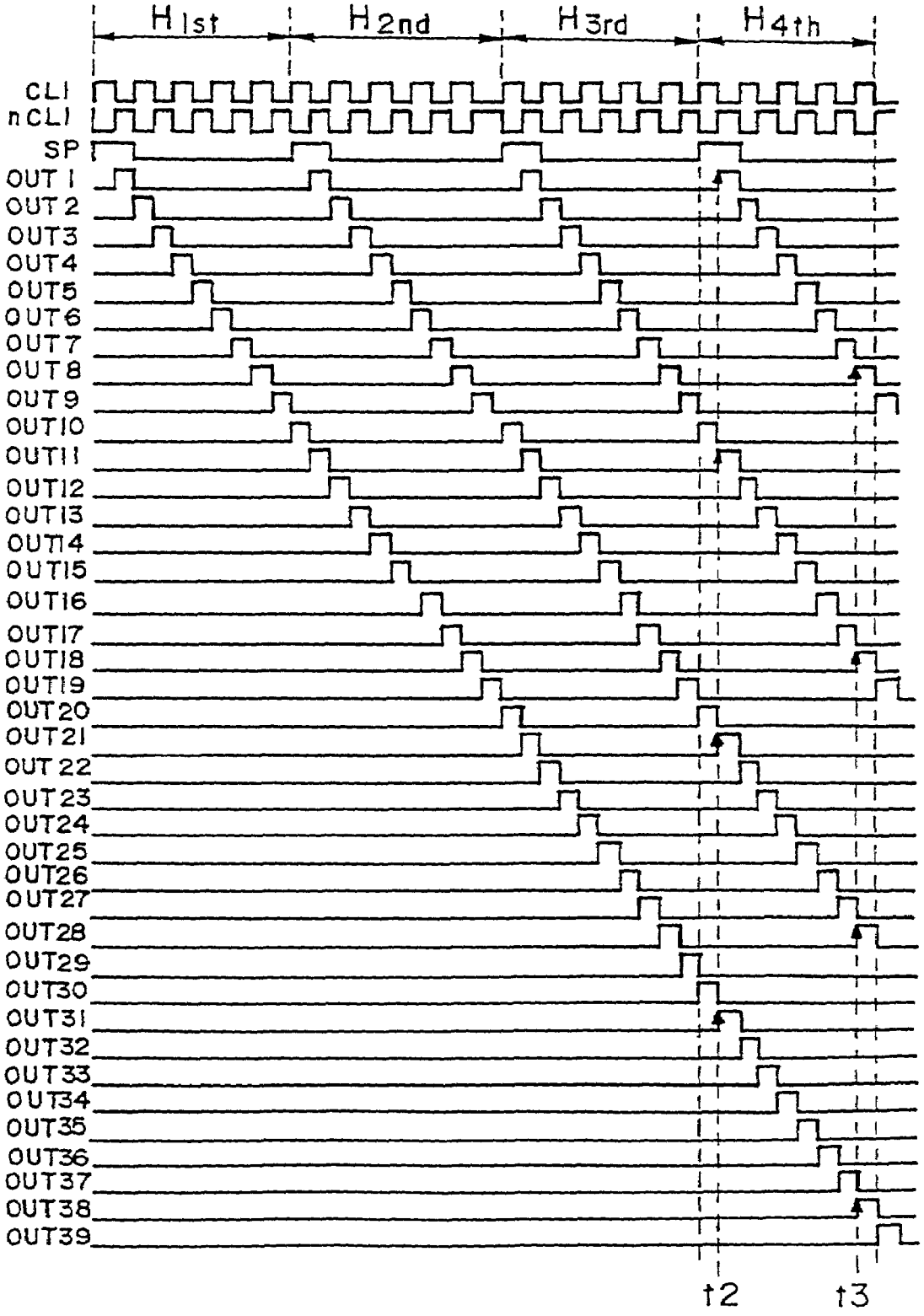
FIG. 10 is a timing chart showing the output timing for the output signal of analog switch 261 shown in FIG. 1A, FIG. 2, and FIG. 3.

This type of operation is repeated; and, as shown in FIG. 10, at the beginning of the fourth select period H4th (time t2), for the first time, four pulses are output simultaneously from the gate circuit 240 (OUT1, OUT11, OUT21, OUT31). Thereafter, each pulse runs parallel in the same direction while maintaining mutual spacing and a state in which four pulses are simultaneously output is steadily realized.

By means of four simultaneously output pulses obtained as described above, the MOS transistors comprising each analog switch 261 are turned on simultaneously, the multiplexed video signal is simultaneously sampled, and the video signal is simultaneously supplied to the corresponding four data lines.

In other words, when a pulse is input, MOS transistors 410 turn on, data lines (D(n)) and video signal lines (S1 to S4) are electrically connected, and the analog signal is written to the data line capacitance 412. Then, when MOS transistors 410 are turned off, the written signal is held in data line capacitances 412. Data line capacitance 412 functions as a holding capacitor. Because the data line drivers are composed only of analog switches, the circuit configuration is simple and it is possible to increase the degree of integration. Additionally, it is possible to accurately sample the video signal. In the case of relatively small liquid crystal panels, it is possible to adequately drive the data lines using a driver having only analog switches as in this example.

In the manner described above, in this example, first, multiple pulses are generated simultaneously using a single shift register. Consequently, it is possible to increase the frequency of the shift register output signal without changing the frequency of the shift register's operation clock. When the number of simultaneously generated pulses is N (N is a natural number of two or greater), the frequency of the shift register output signal becomes N-times.

Then, by using each output signal of the shift register to determine the sampling timing of the video signal from the analog switches, high speed data line driving is realized. As a result, high speed data line driving is possible without increasing power consumption even when the liquid crystal matrix driving circuits are composed of TFTs.

Figure 25A:
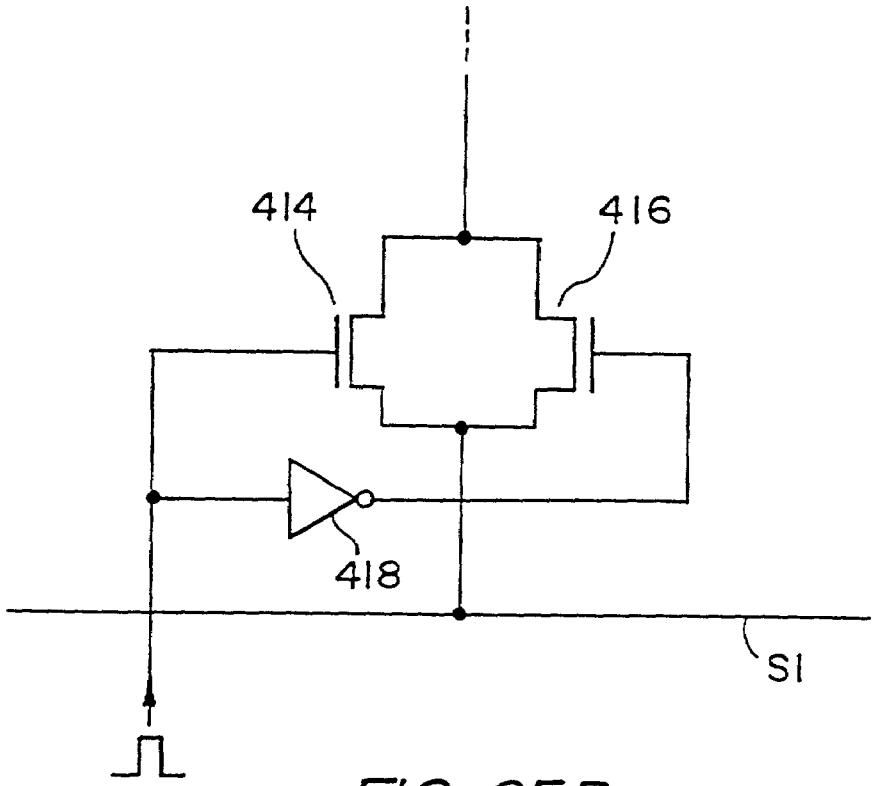
FIG. 25A shows an example of the configuration of an analog switch.

It is also possible to use analog switches comprised of CMOS as shown in FIG. 25A as well as those comprised of single MOS transistors. CMOS switches are comprised of MOS transistors 414 and 416 and inverter 418.

Figure 25B:
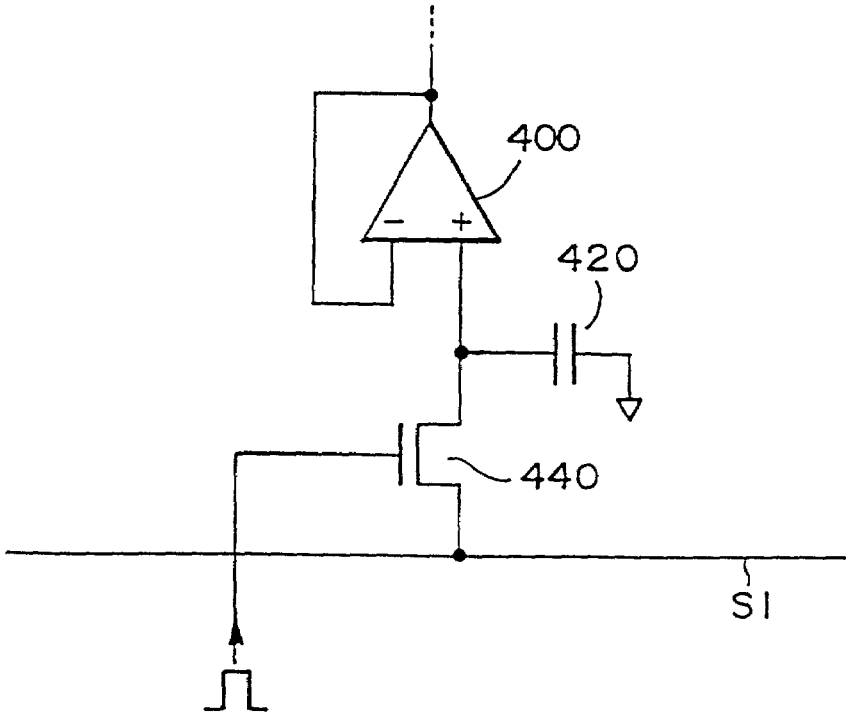
FIG. 25B shows the configuration of an analog driver.

It is also possible to use analog drivers such as shown in FIG. 25B as data line drivers. Analog drivers are composed of a sample and hold circuit containing MOS transistor 440 and holding capacitor 420 and a buffer circuit (voltage follower) 400.

This example has unique effects as described below. In the following, this example will be compared with a comparison example and the unique effects described.

Comparison Example

Figure 11A:
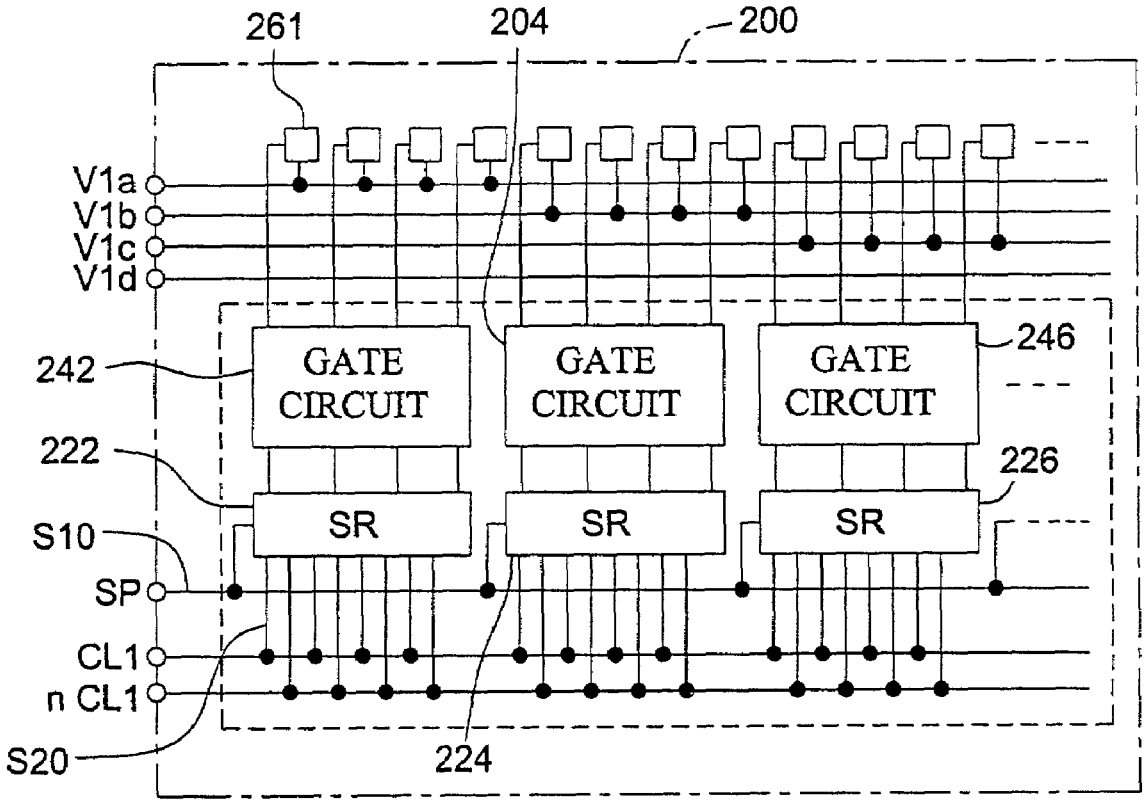
FIG. 11A shows the circuit configuration of a comparison example.
Figure 11B:
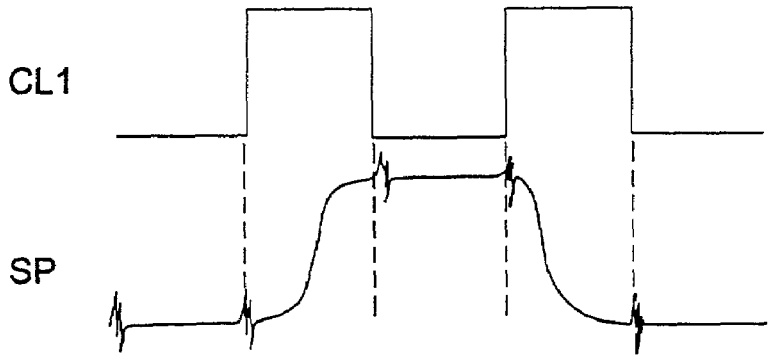
FIG. 11B is the signal waveform showing the problem points of the circuit in FIG. 11A.

FIG. 11A shows the configuration of the data line driving circuit of a comparison example, and FIG. 11B illustrates the problem points of the configuration in FIG. 11A.

In the comparison example of FIG. 11A, there are multiple shift registers (SR) and gate circuits (222 to 226, 242 to 246); and start pulses are supplied individually to each shift register. It is necessary for the input of the start pulses to the shift register to pass through special wiring S10.

In this case, start pulse input wire S10 intersects wire S20 used to input the operation clocks CL1 and nCL1 to each of the shift registers 222, 224, and 226. The result is the superposition of noise on the start pulse as shown in FIG. 11B.

The length of start pulse input wire S10 is at least on the order of 10 μm, and consequently is a major obstacle to miniaturization.

Additionally, the start pulse is delayed by the wiring resistance; and there is the danger that there will be differences in the input timing to each shift register.

Figure 12A:
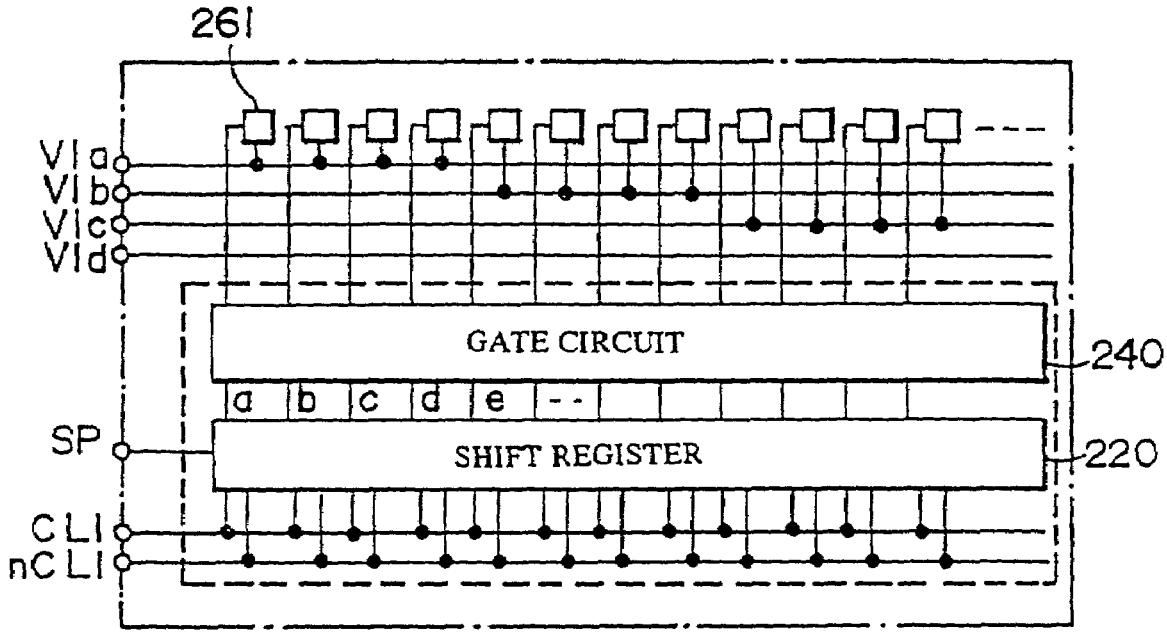
FIG. 12A shows the essential part of the liquid crystal display device of the present invention shown in FIGS. 1A through 3.
Figure 12B:
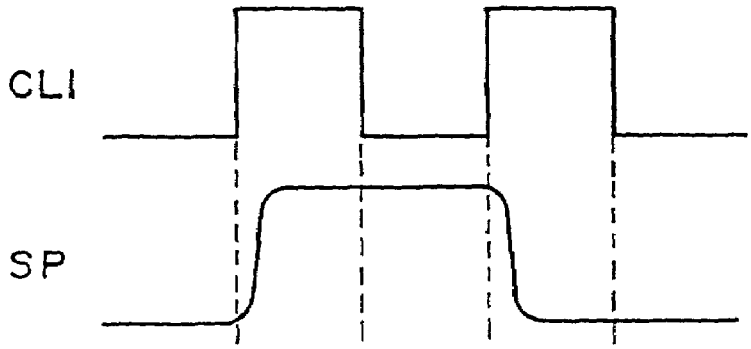
FIG. 12B is a signal waveform showing the advantage of the circuit of FIG. 12A. display device of the present invention.

In contrast, in the data line driving circuit of the present example, as shown in FIG. 12A, if the start pulse (SP) is input at the left side of the single shift register 220 with the desired timing, special start pulse wiring is not necessary.

As a result, in this example, there is no superposition of noise on the start pulse as shown in FIG. 11B, and a reduction in layout area can be achieved.

Also, because multiple pulses are generated by a single shift register, there is no delay in the start pulse.

In such a fashion, according to this invention, it is possible to achieve both miniaturization of the circuits and decrease in the frequency of the shift register operation clocks. Consequently, for example, both high speed and accurate operation can be insured even when TFTs made using a low temperature process are used as the TFTs comprising the data line driving circuit.

Therefore, if the present example is employed, it is possible to improve the performance of liquid crystal display devices having driving circuits composed of TFTs.

TFT Manufacturing Process

FIGS. 22A through 22E show one example of the manufacturing process (low temperature process) when the driver TFTs and the active matrix (pixel) TFTs are formed simultaneously on the substrate. The TFTs produced by this manufacturing process use polysilicon and have an LDD (lightly doped drain) structure.

Figure 22A:
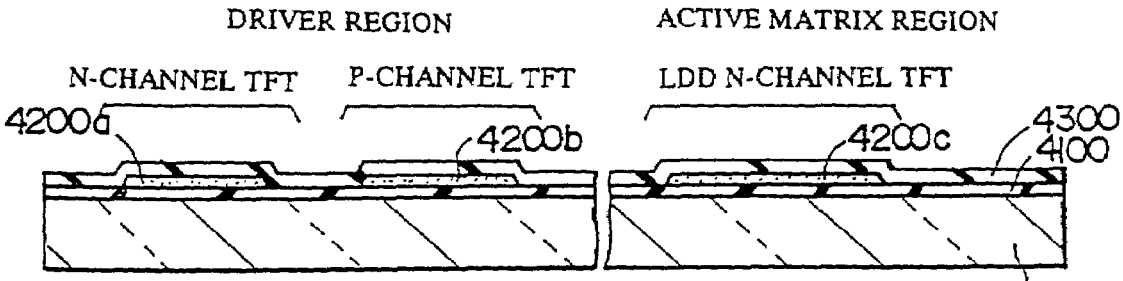
FIG. 22A through FIG. 22E show an example of the fabrication process for simultaneously forming TFTs for the driver region and the active matrix region with the device cross-section shown for each process.

First, insulating layer 4100 is formed on top of glass substrate 4000. Following the formation of polysilicon islands (4200*a*, 4200*b*, 4200*c*) on top of insulating layer 4100, the gate oxide layer 4300 is formed over the entire surface (FIG. 22A).

Figure 22B:
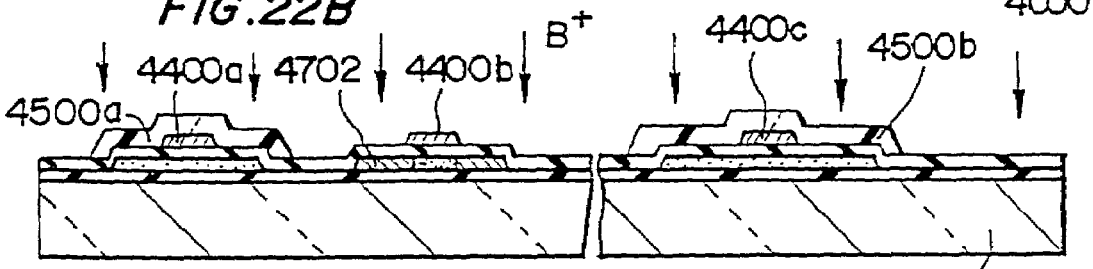

Next, after forming gate electrodes 4400*a*, 4400*b* and 4400*c*, mask material 4500*a* and 4500*b* are formed. Next, boron is ion implanted to a high concentration and p-type source and drain regions 4702 are formed (FIG. 22*b*).

Figure 22C:
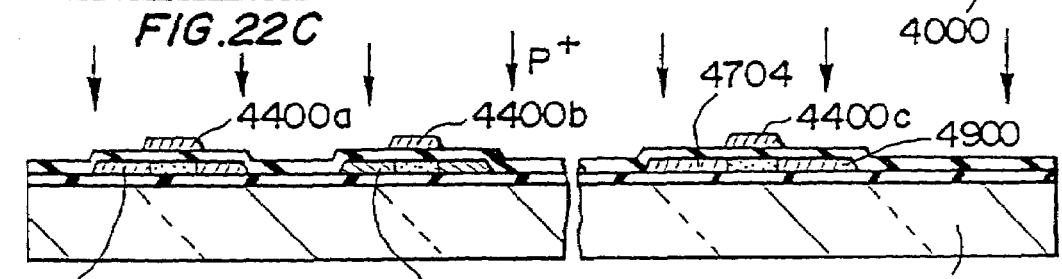

Mask material 4500*a* and 4500*b* is then removed, phosphorous is ion implanted and n-type source and drain regions 4700 and 4900 are formed (FIG. 22C).

Figure 22D:
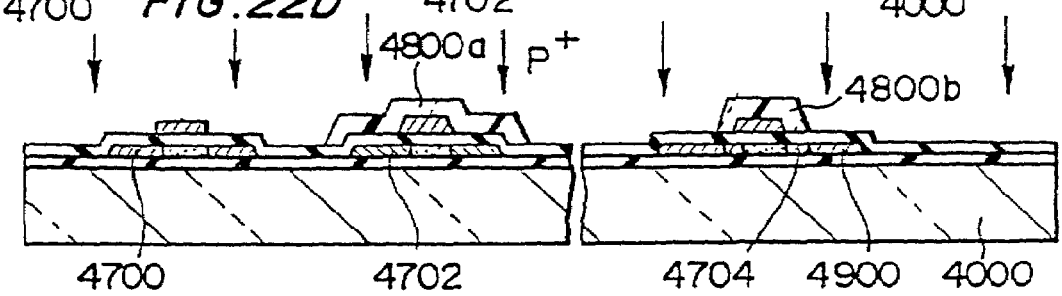
Figure 22E:
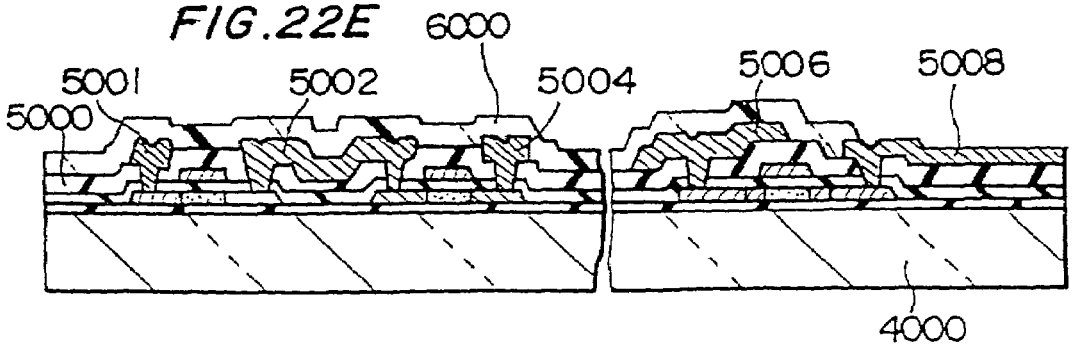

After mask material 4800*a* and 4800*b* is formed, phosphorous is ion implanted (FIG. 22D).

Interlayer dielectric layer 5000; metal electrodes 5001, 5002, 5004, 5006, 5008; and final passivation layer 6000 are formed to complete the device.

Example 2

The present invention is applicable not only to data line driving circuits using analog drivers but also to data line driving circuits using digital drivers.

Figure 8:
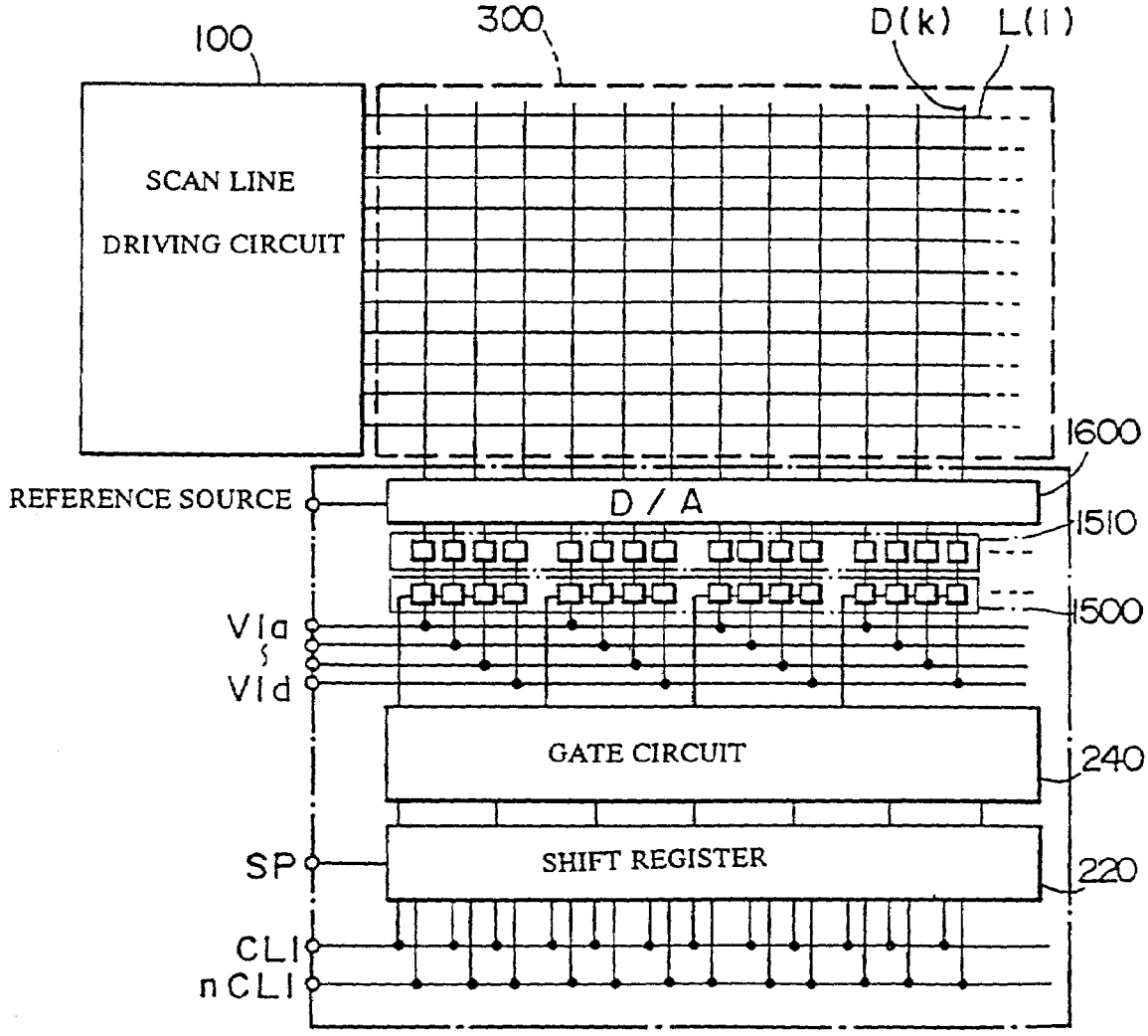
FIG. 8 shows an example of the configuration of liquid crystal matrix driving circuits for the digital line-sequential method.

FIG. 8 shows an example of the configuration of a line sequential driving data line driving circuit using digital drivers.

The special features of the configuration of this circuit include first latch 1500 which takes in the digital video signal (V1*a* to V1*d*) and stores it temporarily, second latch 1510 which collectively takes in each data bit from first latch

1500 and stores it temporarily, and D/A converter 1600 which simultaneously converts every digital data bit from second latch 1510 into an analog signal and simultaneously drives all the data lines.

The technology shown in the first example above is also applicable to the handling of the digital video signal (V1*a* to V1*d*) in first latch 1500 in circuits using digital drivers as described above. In other words, by multiplexing the digital video signal (V1*a* to V1*d*) and, further, simultaneously generating multiple pulses from a single shift register and then using these pulses to latch in parallel multiple data of the digital video signal, it is possible to increase the latch speed of the digital video signal without increasing the frequency of the shift register operation clocks.

Figure 7:
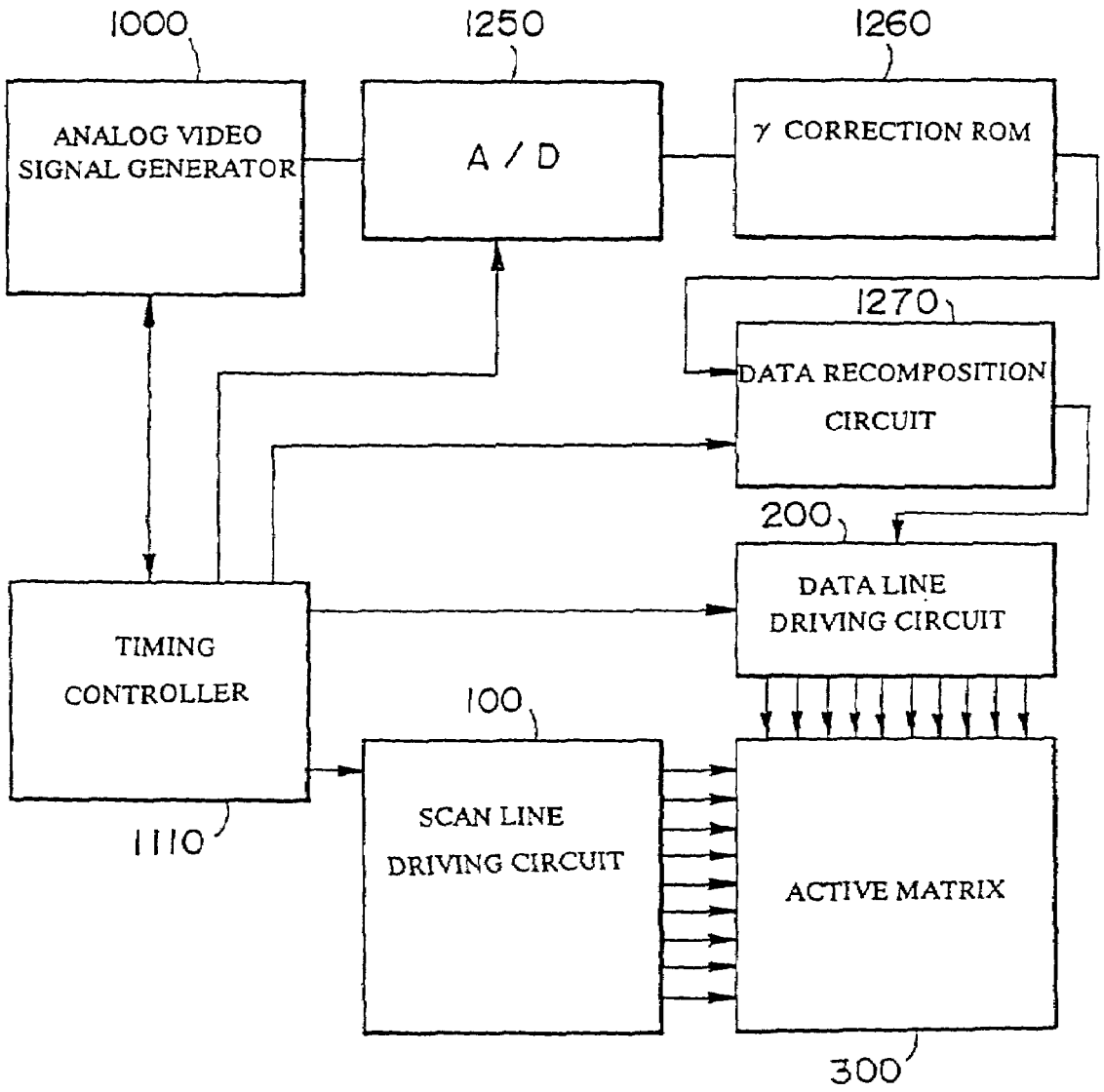
FIG. 7 shows an example of the circuit configuration for processing a digital signal into a multiplexed signal as shown in FIG. 4B.

The multiplexing of the digital video signal can be realized, for example, by data recomposition circuit 1270 shown in FIG. 7. In FIG. 7, reference number 1000 indicates an analog video signal generator; reference number 1250 indicates an A/D converter circuit; reference number 1260 indicates a γ_correction ROM; and reference number 1110 indicates a timing controller.

The present invention is not limited to line sequential driving digital drivers, but is also can be applicable to point sequential driving digital drivers.

Example 3

Figure 19A:
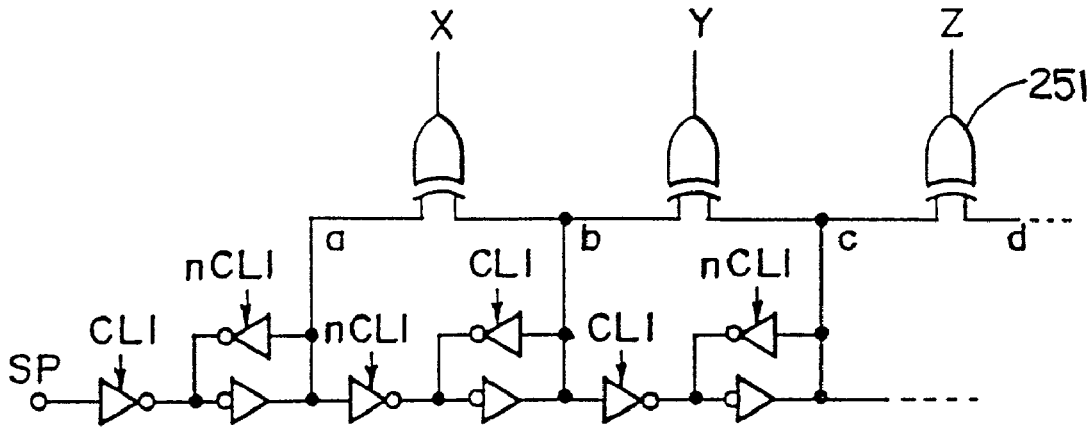
FIG. 19A shows the configuration of the essential part of the driving circuits of the present invention.
Figure 19B:
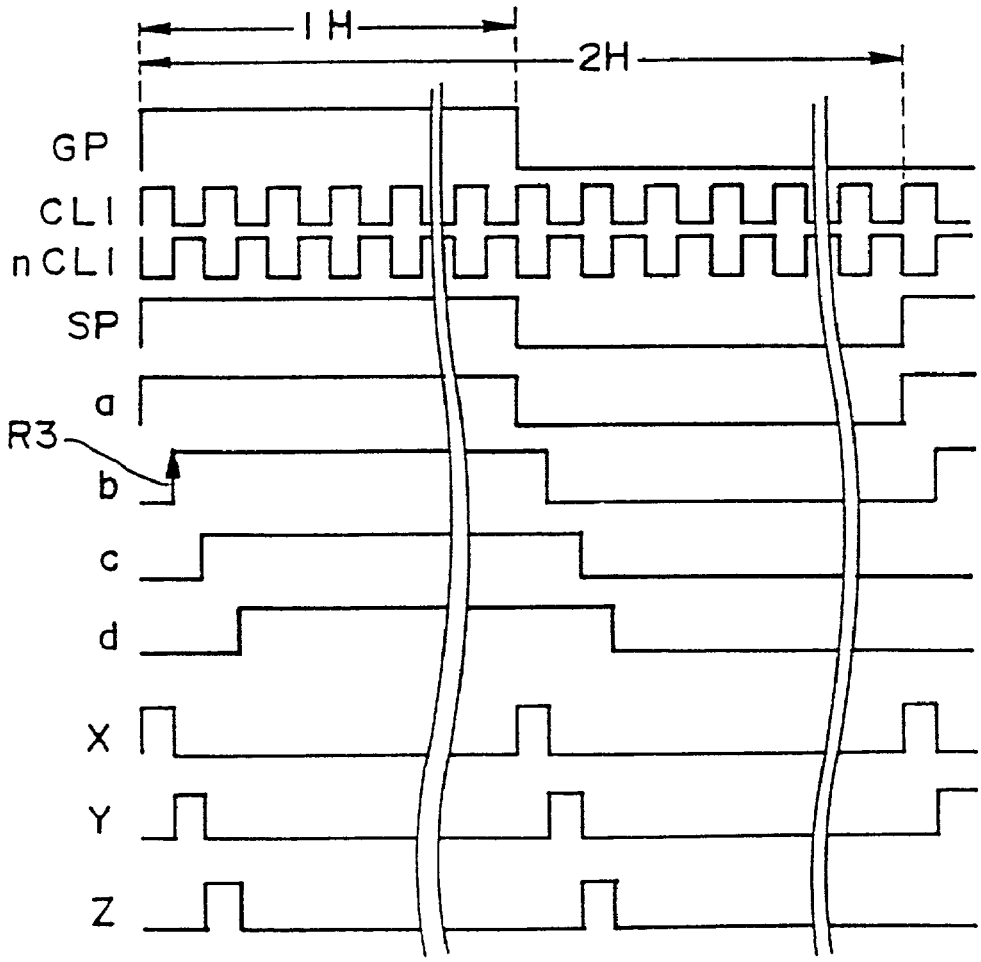
FIG. 19B is a timing chart showing an example of the normal operation of the driving circuit of FIG. 19A.

The special features of the third example of the present invention are shown in FIGS. 19A and 19B. In the first example, gate circuit 240 was composed of NAND gates (FIG. 3); but in this example, gate circuit 240 is composed of EXCLUSIVE-OR gates 251. EXCLUSIVE-OR gates 251 take as inputs the outputs from two adjacent stages of the shift register (a, b . . . ) and output pulses (X, Y, Z . . . ) used to determine the sampling timing of the video signal.

The advantages of using EXCLUSIVE-OR gates 251 are that it is possible to reduce power consumption if one period of the start pulse (SP) is made equivalent to two select periods (twice the select period) and it is possible to avoid the spread of the pulse width since the trailing edge of the output pulse becomes sharp.

That is, as shown in FIG. 3, when one period of the start pulse (SP) is made equivalent to two select periods (twice the select period), along with the parallel output of pulses as a result of the circuit operation similar to that shown in FIG. 9, the number of level changes of the output (a, b . . . ) of each stage of the shift register in one select period is half when compared to the type of operation shown in FIG. 9.

In other words, as shown in FIG. 19B, there is one signal level change within one select period (1H) at point b in FIG. 19A. That is, in one select period (1H), there is only one positive edge R3.

In contrast, in the circuit operation shown in FIG. 9, the signal level at point b changes twice within one select period (1H). In one select period (1H), there are both positive edge R1 and negative edge R2. Consequently, in comparison to the case of FIG. 9, the number of signal level changes for the case of FIG. 19 is reduced by half; and, accompanying this, the power consumption is reduced to about half.

Figure 24A:
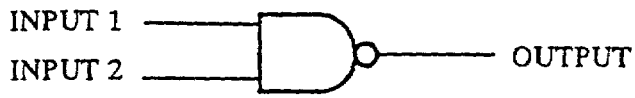
FIG. 24A shows a NAND gate using p-channel and n-channel TFTs.
Figure 24B:
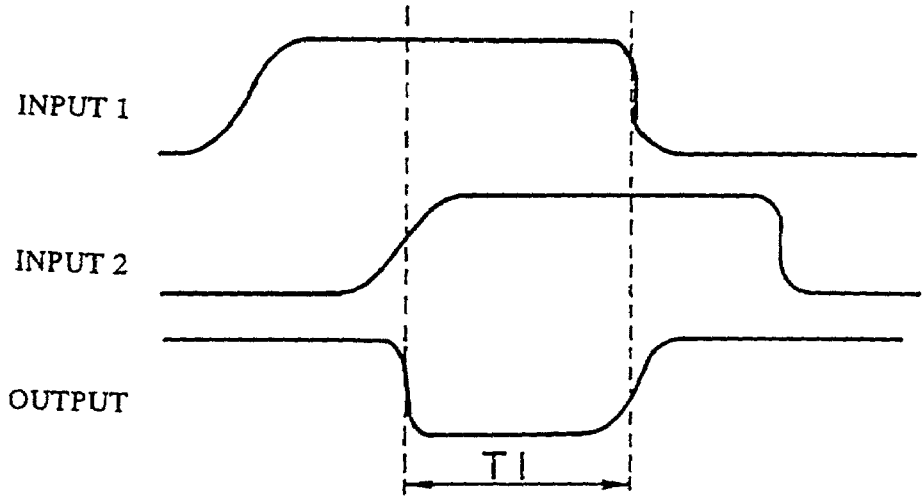
FIG. 24B shows input and output waveforms for the circuit of FIG. 24A.
Figure 24C:
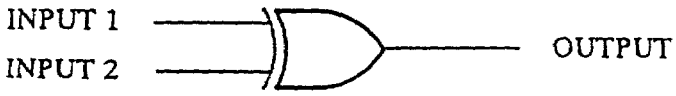
FIG. 24C shows an EXCLUSIVE-OR gate using p-channel and n-channel TFTs.
Figure 24D:
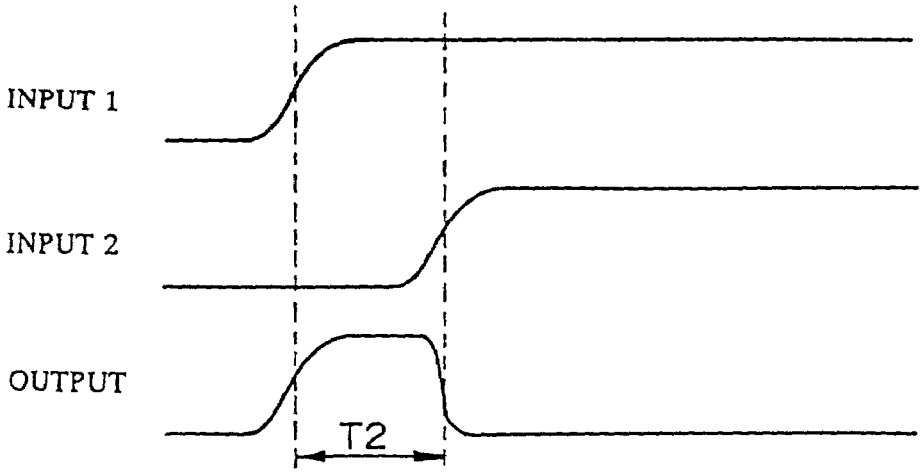
FIG. 24D shows input and output waveforms for the circuit of FIG. 24C.

Also, as shown in FIG. 24B, in contrast to the case of a two input NAND gate (shown in FIG. 24A) in which the output pulse width (T1) is determined by the positive edge for one input and the negative edge for the other input, in the case of a two input EXCLUSIVE-OR gate (FIG. 24C), the output pulse width (T2) is determined by positive edges for both inputs. Because of this, the trailing edge of the output pulse becomes sharp; and spread of the pulse width can be prevented.

Example 4

Figure 13A:
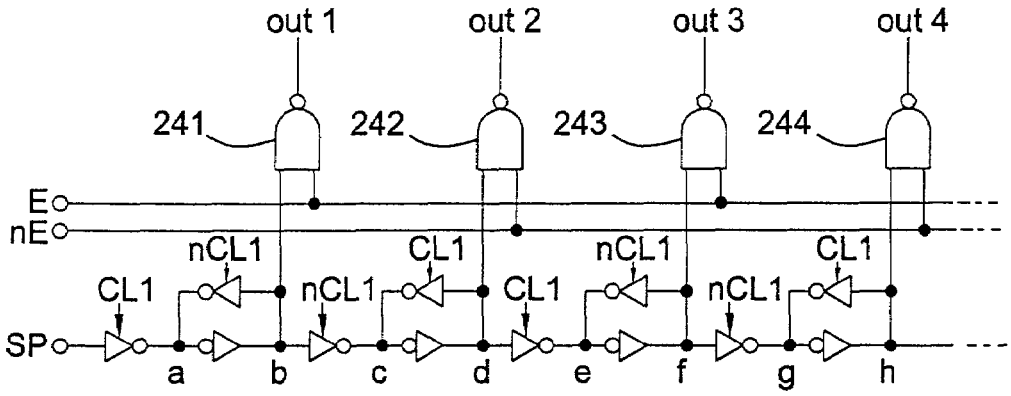
FIG. 13B is a timing chart to explain an example of the operation of the circuit in FIG. 13A.

FIG. 13A shows the configuration of the essential component of a fourth example of the present invention.

The special feature of this example is that the gate circuit 240 of FIG. 1 is composed of NAND gates (241, 242, 243, 244 . . . ) which take as inputs the output of each shift register and an output enable signal (E, nE).

By means of the control afforded by the output enable signals (E, nE), the shift register output level and the gate circuit output level are independent and possible to control. By making use of this special feature, while the circuit is in operation, it is possible to both temporarily interrupt the generation of pulses from the NAND gates (241, 242, 243, 244 . . . ) and resume the pulse generation after terminating the interruption.

Figure 13B:
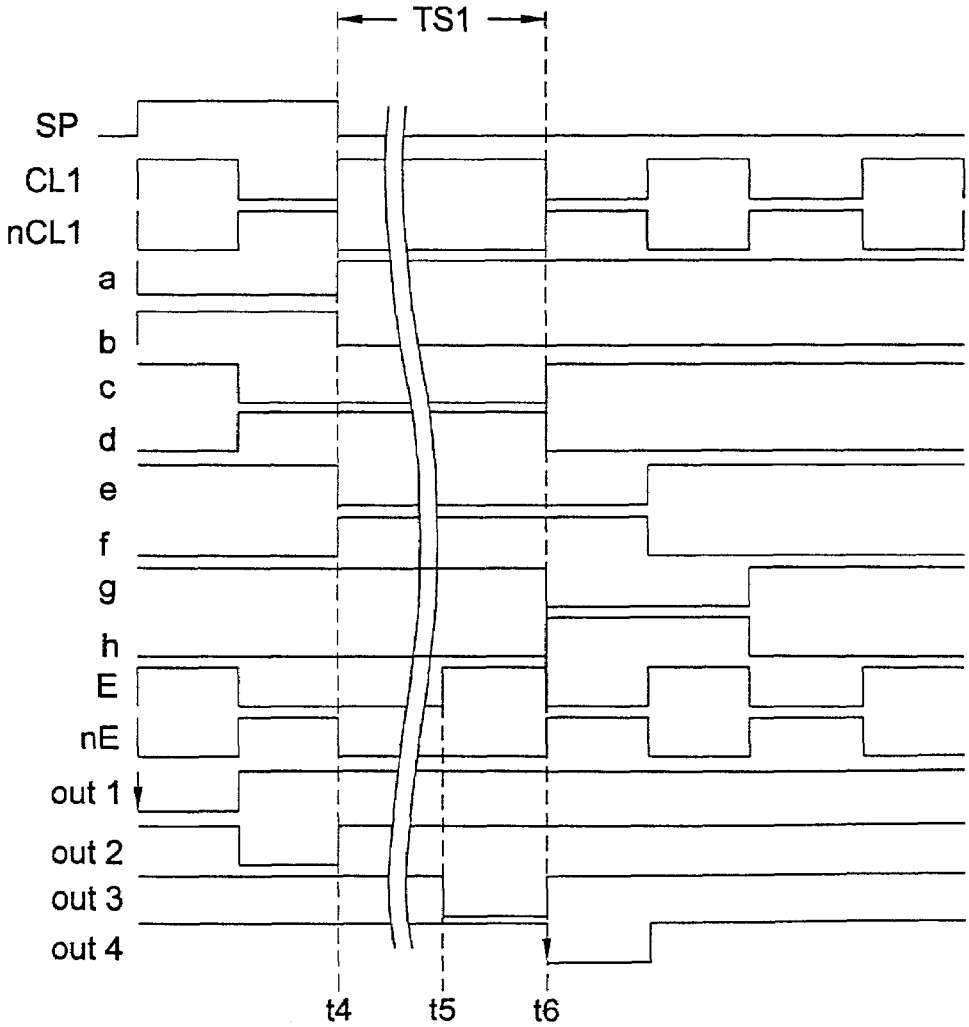

For example, in FIG. 13B, consider the cessation of NAND gate (241, 242, 243, 244 . . . ) pulse generation from time t4 to t6 (period TS1) and the resumption of pulse generation at time t6.

This type of operation can be achieved by stopping operation clocks CL1 and nCL1 during period TS1; and, on the other hand, fixing the output enable signal (E) at low level from time t4 to time t5, and then resuming the variation to that of the same period as the operation clock at time t5. It is sufficient if output enable signal (nE) resumes to that of the same period as the operation clocks at time t6.

This type of pulse generation interruption technology can be used, for example, to prevent video signal sampling during the horizontal blanking period (BL).

Figure 14:
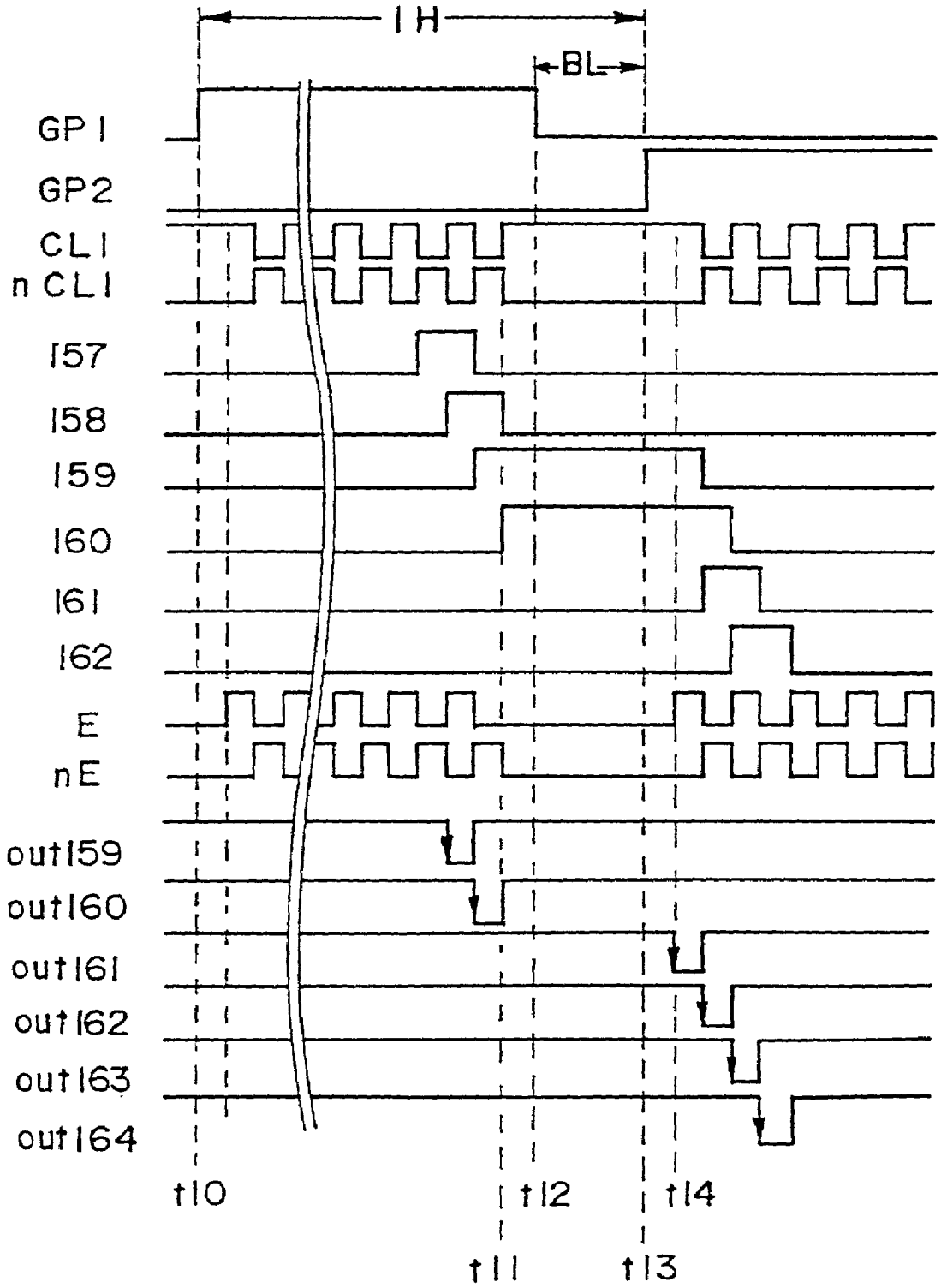
FIG. 14 is timing chart for another example of the operation of the circuit shown in FIG. 13A.

FIG. 14 shows the interruption of gate circuit pulse generation during the horizontal blanking period (times t12 to t13) in an actual circuit. In FIG. 14, for example, 157 indicates the output of stage 157 of the single shift register and OUT159 indicates the output of the 159th NAND gate.

As shown clearly in FIG. 14, in order to stop the generation of pulses from the gate circuit during the horizontal blanking period (time t12 to t13), it is necessary to stop the operation clocks (CL1, nCL1) and the enable signals (n, nE) between times t1 and t4.

Example 5

The liquid crystal display device shown in FIG. 1 is also suitable for inspecting the electrical characteristics of the data lines and other components. That is, as shown in the top of FIG. 15, by providing inspection signal input circuit 2000, it is possible to accurately and quickly detect such things as data line and analog switch frequency characteristics and data line open circuits.

Figure 15:
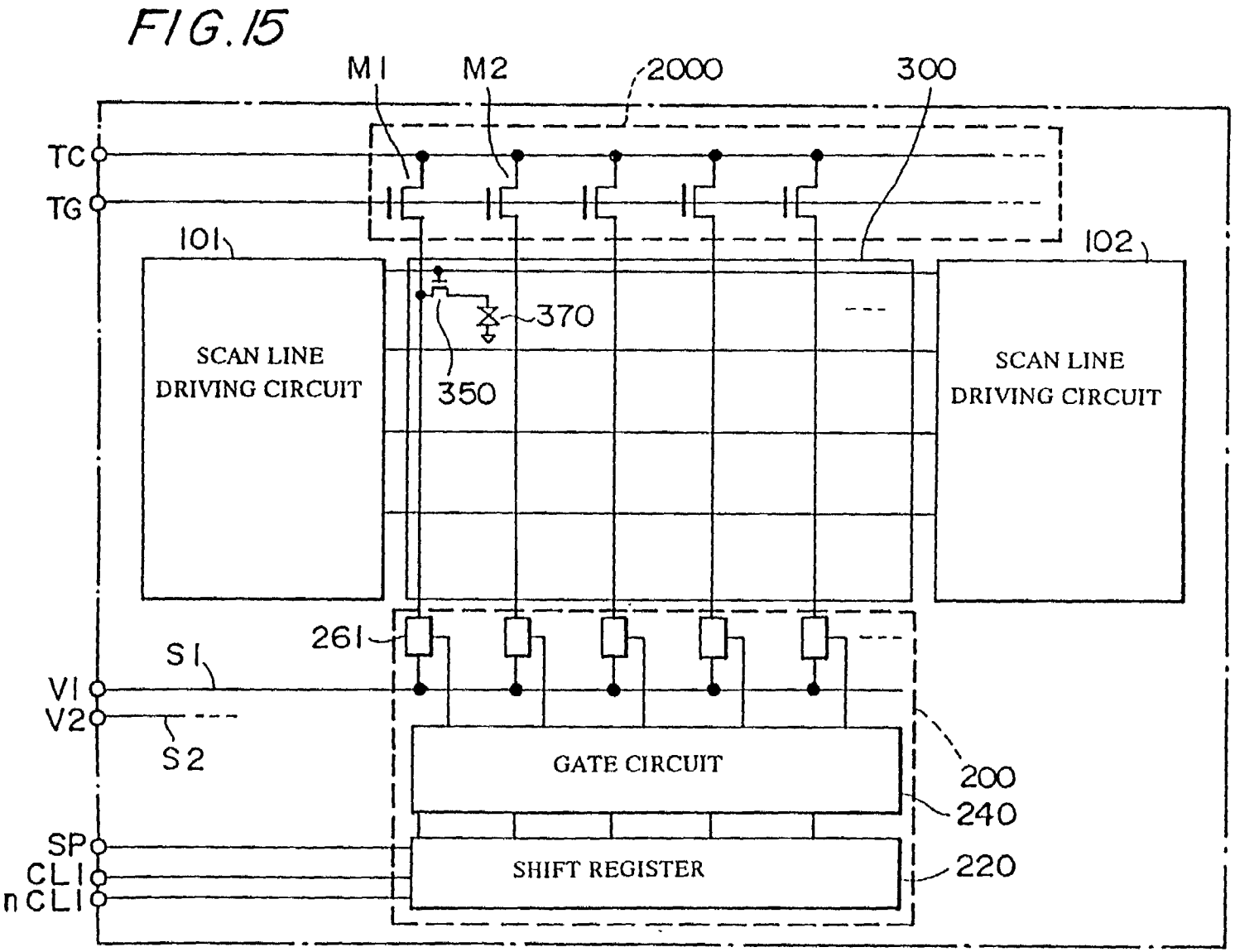
FIG. 15 shows the overall configuration of another example of a liquid crystal display device of the present invention.

In FIG. 15, inspection signal input circuit 2000 is connected to one end of the data lines; and video signal input line S1 is connected to the other end of the data lines via analog switch 261. In FIG. 15, TG represents the test amble signal and TC represents the supply voltage.

Inspection is performed as described below.

First, the test enable signal TG is activated; and the supply voltage (inspection voltage) is collectively supplied to each data line.

Under such an applied voltage state, a single pulse is sequentially output from the single shift register. When this is done, single pulses are output from gate circuit 240. By means of these pulses, the analog switches are turned on sequentially. As a result, the voltage supplied to one end of the data lines can be received through analog switches 261 and video signal input line S1. It is thus possible to inspect the electrical characteristics of the data lines and the analog switches.

Figures 16A, 16B, 16C:
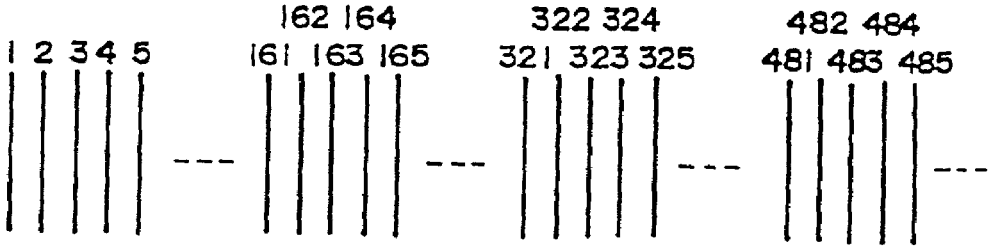
FIG. 16A shows the arrangement of the data lines in the circuit of FIG. 15.
FIG. 16B shows the normal operation of the driving circuits of the present invention.
FIG. 16C shows an example of the operation during defect inspection of the driving circuit of FIG. 16B.

In this example, the generation of single, sequential pulses from the single shift register is necessary. In other words, the data lines are arranged as shown in FIG. 16A. In the previous examples, simultaneous driving of multiple data lines was employed as shown in FIG. 16B; but in the present example, it is necessary to switch to a driving method in which each line is scanned sequentially as shown in FIG. 16C.

Figure 17:
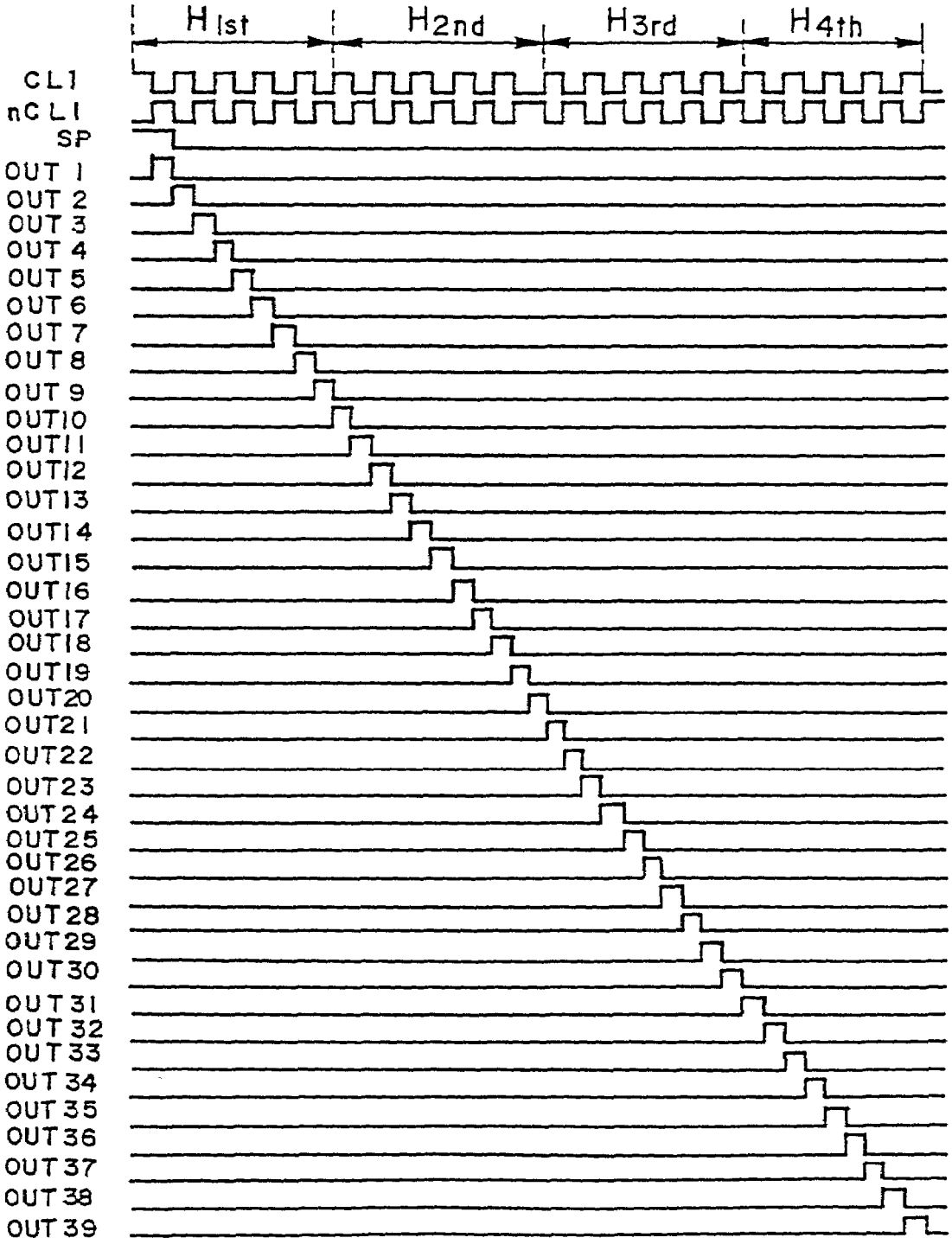
FIG. 17 is a timing chart to explain more specifically the operation of the driving circuits of the present invention shown in FIG. 16C during defect inspection.

This type of switch can be easily accomplished by changing the input method for the start pulse as shown in FIG. 17. In other words, as shown in FIG. 17, a single start pulse (SP) is input at the beginning of the first select period (H1st). If that pulse is shifted across all of the output stages, single pulses are sequentially generated; and, if a single start pulse (SP) is input after each select period, it is possible to simultaneously generate multiple pulses as shown in FIG. 10.

By sequentially generating single pulses from a single shift register, it is possible to check the electrical characteristics of each line; and inspection becomes simple.

Figure 18A:
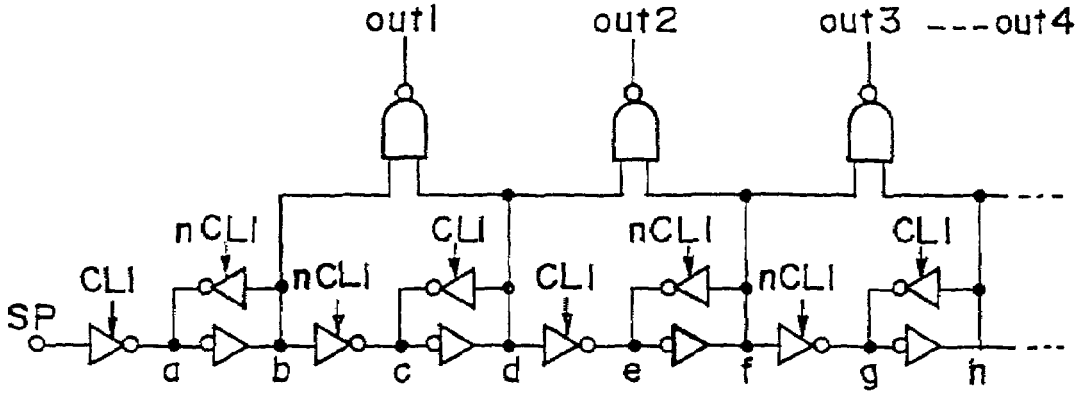
FIG. 18A shows the configuration of the essential part of the driving circuits of the present invention.
Figure 18B:
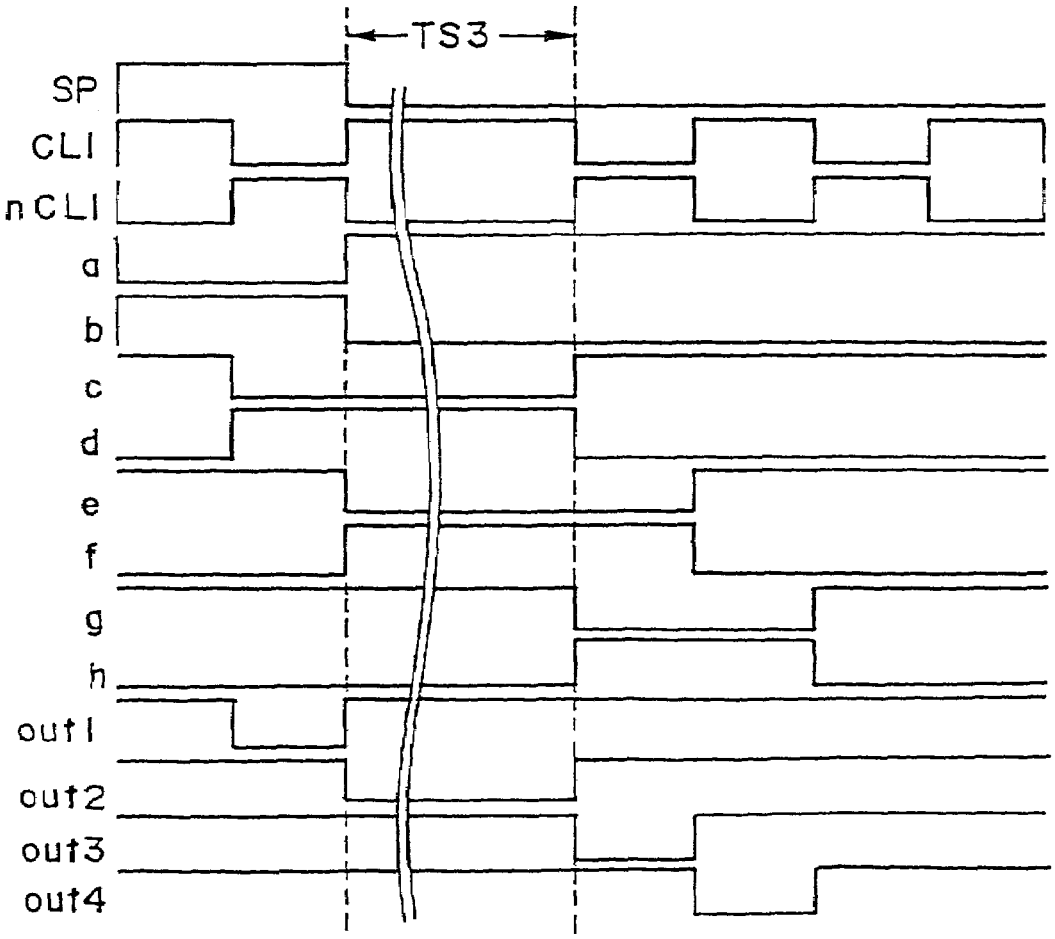
FIG. 18B shows an example of the operation of the circuit of FIG. 18A during defect inspection.

Further, when the configuration of FIG. 18A is used, if shift register operation clocks CL1 and nCL1 are stopped during a fixed period (TS3), only the NAND gate output (OUT1) is at high level during that period as shown in FIG. 18B. Consequently, only the corresponding analog switch will be on; and it is possible to thoroughly inspect just the first data line.

Figure 20:
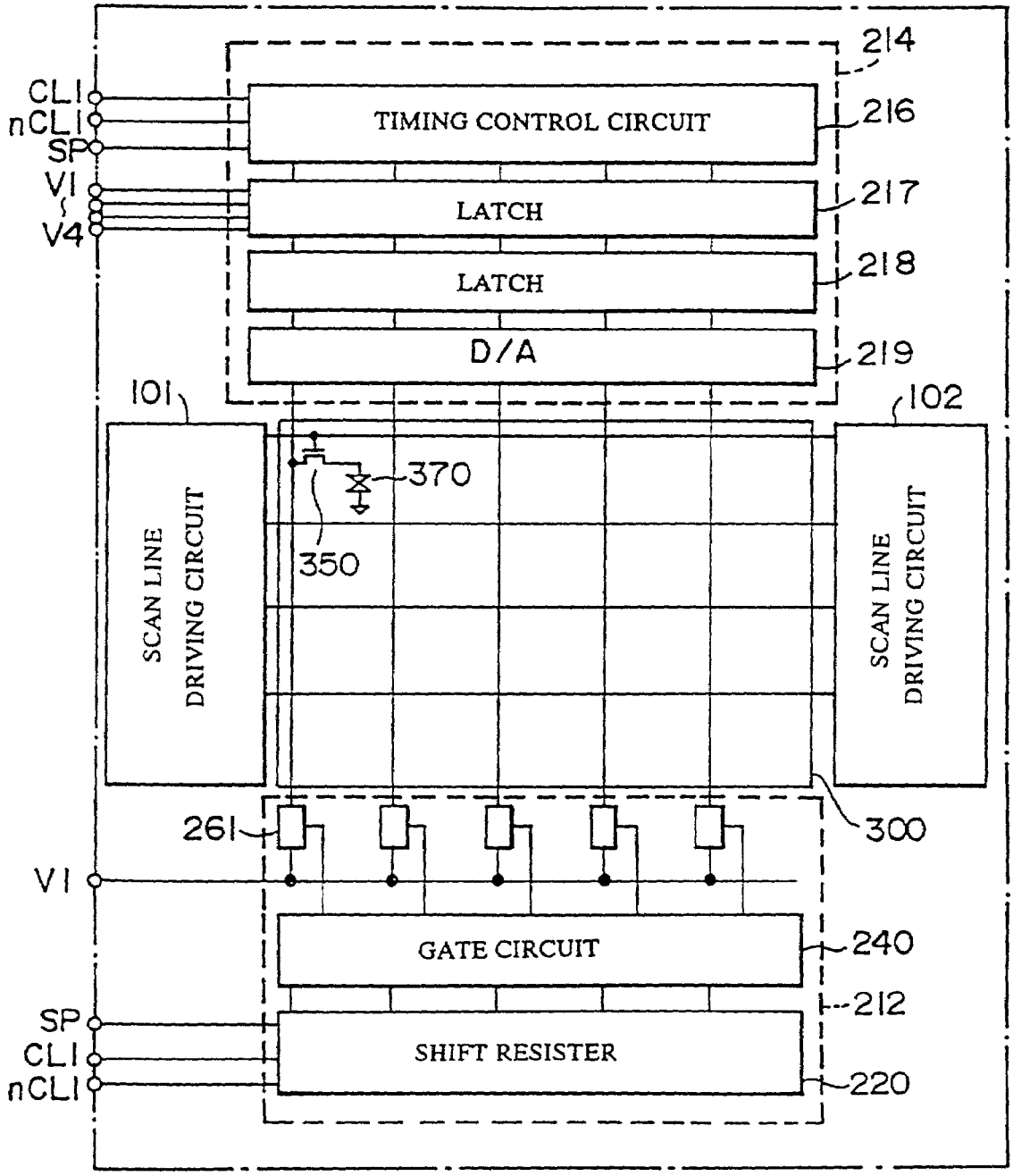
FIG. 20 shows the configuration of another example of a liquid crystal display device of the present invention.

In FIG. 20, instead of the special inspection signal input circuit 2000, it is acceptable to provide line sequential digital driver 214 (having the same configuration as that of FIG. 8). In this case, in addition to operation as a true data line driver, digital driver 214 also functions as an inspection signal input circuit.

In the configuration of FIG. 20, both data line driving based on an analog video signal and data line driving based on a digital video signal are possible.

If the liquid crystal display device described above is used as a display device in equipment such as personal computers, the product value increases.

The invention claimed is:

1. A driving circuit comprising:

a shift register;

a first output enable signal line;

a second output enable signal line;

a video signal line;

a plurality of first NAND circuits, each of the plurality of first NAND circuits electrically connecting the shift register, the each of the plurality of first NAND circuits electrically connecting the first output enable signal line;

a plurality of second NAND circuits, each of the plurality of second NAND circuits electrically connecting the shift register, the each of the plurality of second NAND circuits electrically connecting the second output enable signal line;

a plurality of first analog switches electrically connecting the video signal line, each of the plurality of first analog switches electrically connecting one of the plurality of first NAND circuits; and a plurality of second analog switches electrically connecting the video signal line, each of the plurality of second analog switches electrically connecting one of the plurality of second NAND circuits.

2. The driving circuit according to claim 1, the plurality of first NAND circuits and the plurality of second NAND circuits being arranged alternately.

3. An active matrix substrate comprising:

a plurality of scan lines;

a plurality of data lines crossing the scan lines; and the driving circuit according to claim 1, the plurality of analog switches electrically connecting the plurality of the data lines.

4. The active matrix substrate according to claim 3, the first output enable signal line outputting a first output enable signal, the second output enable signal line outputting a second output enable signal, wherein the second output enable signal line is to be set at a high level when the first output enable signal is to be set at a low level during a pulse generation period.

5. The active matrix substrate according to claim 3, the shift register having a plurality of stages, each of the plurality of stages being adapted to respond to one of a first clock signal and a second clock signal.

6. The active matrix substrate according to claim 5, wherein the first clock signal is to be set at a high level when the first output enable signal is to be set at a high level, and the first clock signal is to be set at a low level when the first output enable signal is to be set at a low level in a pulse generation period.

7. A display device, comprising:

a plurality of scan lines;

a plurality of data lines crossing the scan lines; and the driving circuit according to claim 1, the plurality of analog switches electrically connecting the plurality of the data lines.

8. A driving circuit comprising:

a shift register;

a first output enable signal line;

a second output enable signal line;

a video signal line;

a plurality of first NAND circuits, each of the plurality of first NAND circuits controlled by a first output signal and a second output signal, the first output signal being outputted from the shift register, the second output signal being outputted from the first output enable signal line;

a plurality of second NAND circuits, each of the plurality of second NAND circuits controlled by a third output signal and a fourth output signal, the third output signal being outputted from the shift register, the fourth output signal being outputted from the second output enable signal line;

a plurality of first analog switches provided a video signal from the video signal line, each of the plurality of first analog switches being controlled by an output from one of the plurality of first NAND circuits; and a plurality of second analog switches provided a video signal from the video signal line, each of the plurality of second analog switches being controlled by an output from one of the plurality of second NAND circuits.

* * * * *